US012507760B2

(12) United States Patent
Ishikawa et al.

(10) Patent No.: US 12,507,760 B2
(45) Date of Patent: Dec. 30, 2025

(54) SHOE SOLE AND SHOE

(71) Applicant: ASICS CORPORATION, Kobe (JP)

(72) Inventors: Tatsuya Ishikawa, Kobe (JP); Koji Otobe, Kobe (JP); Akane Yoneda, Kobe (JP); Tomoichiro Ozaki, Kobe (JP); Hiroyuki Ichikawa, Kobe (JP)

(73) Assignee: ASICS CORPORATION, Kobe (JP)

( * ) Notice: Subject to any disclaimer, the term of this patent is extended or adjusted under 35 U.S.C. 154(b) by 40 days.

(21) Appl. No.: 18/554,117

(22) PCT Filed: Apr. 7, 2021

(86) PCT No.: PCT/JP2021/014803

§ 371 (c)(1),
(2) Date: Oct. 5, 2023

(87) PCT Pub. No.: WO2022/215202

PCT Pub. Date: Oct. 13, 2022

(65) Prior Publication Data

US 2024/0188675 A1 Jun. 13, 2024

(51) Int. Cl.
*A43B 13/02* (2022.01)
*A43B 7/1425* (2022.01)
(Continued)

(52) U.S. Cl.
CPC ..... *A43B 13/026* (2013.01); *A43B 7/1425* (2013.01); *A43B 7/144* (2013.01); *A43B 7/1445* (2013.01); *A43B 13/146* (2013.01)

(58) Field of Classification Search
None
See application file for complete search history.

(56) References Cited

U.S. PATENT DOCUMENTS 4,936,028 A * 6/1990 Posacki ..... A43B 13/36 36/15
6,401,366 B2 * 6/2002 Foxen ..... A43B 7/1495 36/102

(Continued)

FOREIGN PATENT DOCUMENTS

JP 2005-095388 A 4/2005
WO 2019/073504 A1 4/2019

OTHER PUBLICATIONS

International Search Report issued in PCT/JP2021/014803; mailed Jun. 15, 2021.

(Continued)

*Primary Examiner* — Jila M Mohandesi
(74) *Attorney, Agent, or Firm* — Studebaker Brackett PLLC

(57) ABSTRACT

A shoe sole includes a sole body, and a reinforcing structure portion made up of a first reinforcing member and a second reinforcing member that are made of different members from each other. The first reinforcing member includes a first bar, and the second reinforcing member includes a second bar. The first bar is located on a medial foot side from the second bar. A portion of the first bar disposed in a midfoot portion extends along an oblique direction crossing both a front-rear direction and a left-right direction, and a portion of the second bar disposed in the midfoot portion extends crossing the left-right direction. The portion of the first bar disposed in the midfoot portion and the portion of the second bar disposed in the midfoot portion are located at least in part with a distance therebetween.

17 Claims, 16 Drawing Sheets

(51) Int. Cl.

| | |
|---|---|
| ***A43B 7/144*** | (2022.01) |
| ***A43B 7/1445*** | (2022.01) |
| ***A43B 13/14*** | (2006.01) |

(56) References Cited

U.S. PATENT DOCUMENTS

| | | | | |
|---|---|---|---|---|
| 6,497,058 | B2 * | 12/2002 | Dietrich | A43B 13/14 36/31 |
| 7,082,702 | B2 * | 8/2006 | Cretinon | A43B 13/026 36/76 R |
| 7,647,709 | B2 * | 1/2010 | Reilly | A43B 23/17 36/107 |
| 7,685,740 | B2 * | 3/2010 | Sokolowski | A43B 7/142 36/77 R |
| 7,818,897 | B2 * | 10/2010 | Geer | B29D 35/061 36/31 |
| 7,997,013 | B2 * | 8/2011 | Reilly | A43B 13/12 36/107 |
| 8,011,119 | B2 * | 9/2011 | Tvoua | A43B 3/26 36/97 |
| 8,365,440 | B2 * | 2/2013 | Rivas | A43B 7/18 36/107 |
| 8,387,279 | B2 * | 3/2013 | Pauk | A43B 13/122 36/27 |
| 8,732,984 | B2 * | 5/2014 | Ha | A43B 13/181 36/28 |
| 9,089,185 | B2 * | 7/2015 | Nishiwaki | A43B 13/12 |
| 9,930,934 | B2 * | 4/2018 | Cook | A43B 13/141 |
| 10,231,512 | B2 * | 3/2019 | Lucca | A43B 13/223 |
| 10,575,585 | B2 * | 3/2020 | Kirk | A43B 5/02 |
| 10,588,378 | B2 * | 3/2020 | Groeneweg | A43B 23/227 |
| 10,617,172 | B2 * | 4/2020 | Cohen | A43B 17/00 |
| 10,721,998 | B1 * | 7/2020 | Koo | A43C 11/00 |
| 12,369,682 | B2 * | 7/2025 | Ishikawa | A43B 13/186 |
| 2001/0001907 | A1 * | 5/2001 | Luthi | A43B 7/1425 36/144 |
| 2005/0034328 | A1 | 2/2005 | Geer | |
| 2005/0278980 | A1 * | 12/2005 | Berend | A43B 7/143 36/103 |
| 2006/0064905 | A1 * | 3/2006 | Hudson | A43B 13/125 36/30 R |
| 2015/0282559 | A1 * | 10/2015 | Nishiwaki | A43B 13/16 36/31 |
| 2017/0347747 | A1 | 12/2017 | Groeneweg et al. | |
| 2020/0214389 | A1 | 7/2020 | Hatano et al. | |
| 2020/0383425 | A1 * | 12/2020 | Peyton | A43B 13/125 |

OTHER PUBLICATIONS

The extended European search report issued by the European Patent Office on Mar. 18, 2024, which corresponds to European Patent Application No. 21936006.2-1015 and is related to U.S. Appl. No. 18/554,117.

* cited by examiner

SHOE SOLE AND SHOE

TECHNICAL FIELD

The present invention relates to a shoe sole in which a reinforcing structure portion is provided in a sole body, and a shoe including the shoe sole.

BACKGROUND ART

Generally, in a shoe used for ball sports or the like, there is a demand for a shoe that is excellent in an assisting function for swiftly and smoothly performing a change in direction (a so-called cutting maneuver), while also performing a travel assisting function. For example, WO 2019/073504 (PTL 1) discloses a shoe that improves these assisting functions.

In the shoe disclosed in PTL 1, a reinforcing structure portion made up of a reinforcing member, which is formed of a material higher in rigidity than a material forming a midsole, is provided in the midsole as a sole body. In more detail, the reinforcing member is made of a single member in which a plurality of mutually parallel bars is provided, and each of the plurality of bars is disposed extending in an oblique direction, on a lower surface of the midsole, such that one end thereof is located at a portion of a forefoot portion on a lateral foot side and the other end thereof is located at a portion near a rear end of a midfoot portion on a medial foot side. In this way, an interposed portion, which is formed by a part of the midsole made of a material lower in rigidity than the reinforcing member, is disposed between the plurality of bars, and this interposed portion extends along a same direction as the direction in which the plurality of bars extends.

In the case where formed in such a manner, twisting easily occurs between a portion of a forefoot portion on the medial foot side and a portion of a rearfoot portion on the lateral foot side, around an axis in a direction where the interposed portion extends, at the location where the interposed portion is provided. Therefore, in association with this, an impulse of brake at the time of a cutting maneuver increases, and as a result, a swift and smooth cutting maneuver can be realized.

Moreover, in the case where formed in such a manner, the plurality of bars is disposed extending in a direction crossing a left-right direction of the shoe sole. Therefore, a bending stiffness against dorsal flexion of the shoe sole around an axis in the left-right direction also increases, and as a result of this, a function for assisting a start-off at the time of a cutting maneuver (namely, an acceleration assisting function), and a function for increasing a propulsive force to the front at the time of traveling (namely, a travel assisting function), also improve.

CITATION LIST

Patent Literature

PTL 1: WO 2019/073504 A

SUMMARY OF INVENTION

Technical Problem

However, in the shoe disclosed in PTL 1, since the reinforcing structure portion is made up of a reinforcing member made of a single member such as stated above, a limit naturally occurs in variously adjusting the performance of the reinforcing structure portion exhibited at the time of a cutting maneuver, in accordance with a usage of the shoe (for example, in accordance with an athletic event or the like for which the shoe is used). Accordingly, it cannot be said that an optimal design corresponding to a usage of the shoe is necessarily performed easily, and there is still room for improvement in terms of this point.

Therefore, an object of the present invention, which has been made to solve the above-stated problem, is to enable a shoe sole, in which a reinforcing structure portion is provided that exhibits a desired performance in accordance with a usage, and a shoe including the shoe sole, to be easily manufactured.

Solution to Problem

A shoe sole based on a first aspect of the present invention is a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a sole body and a reinforcing structure portion. The sole body is located continuously from the forefoot portion to the rearfoot portion, and the reinforcing structure portion is assembled on the sole body. The reinforcing structure portion has a first reinforcing member formed of a material higher in rigidity than a material forming the sole body, and a second reinforcing member formed of a material higher in rigidity than the material forming the sole body, the second reinforcing member being made of a different member from the first reinforcing member. The first reinforcing member includes a first bar with at least a portion thereof disposed in the midfoot portion, and the second reinforcing member includes a second bar with at least a portion thereof disposed in the midfoot portion. The first bar is located on a medial foot side from the second bar in a left-right direction that is a direction coinciding with a foot width direction of the foot of the wearer. The portion of the first bar disposed in the midfoot portion extends along an oblique direction crossing both the front-rear direction and the left-right direction such that a front end thereof is located on a lateral foot side in the left-right direction and a rear end thereof is located on the medial foot side in the left-right direction. The portion of the second bar disposed in the midfoot portion extends crossing the left-right direction such that a front end thereof is located on the lateral foot side in the left-right direction. The portion of the first bar disposed in the midfoot portion and the portion of the second bar disposed in the midfoot portion are located at least in part with a distance therebetween.

A shoe sole based on a second aspect of the present invention a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a sole body and a reinforcing structure portion. The sole body is located continuously from the forefoot portion to the rearfoot portion, and the reinforcing structure portion is assembled on the sole body. The reinforcing structure portion has a first reinforcing member formed of a material higher in rigidity than a material forming the sole body, and a second reinforcing member formed of a material higher in rigidity than the material forming the sole body, the second reinforcing member being made of a different member from the first reinforcing member. The first reinforcing member includes a first bar with at least a portion thereof disposed in the midfoot portion, and the second reinforcing member includes a second bar with at least a portion thereof disposed in the midfoot portion. The first bar is located on a medial foot side from the second bar in a left-right direction that is a direction coinciding with a foot width direction of the foot of the wearer. The portion of the first bar disposed in the midfoot portion extends crossing the left-right direction such that a rear end thereof is located on the medial foot side in the left-right direction. The portion of the second bar disposed in the midfoot portion extends along an oblique direction crossing both the front-rear direction and the left-right direction such that a front end thereof is located on a lateral foot side in the left-right direction and a rear end thereof is located on the medial foot side in the left-right direction. The portion of the first bar disposed in the midfoot portion and the portion of the second bar disposed in the midfoot portion are located at least in part with a distance therebetween.

A shoe based on the present invention is a shoe that includes either the shoe sole based on the above-stated first aspect of the present invention or the shoe sole based on the above-stated second aspect of the present invention, and an upper located above the shoe sole.

Advantageous Effects of Invention

According to the present invention, a shoe sole, in which a reinforcing structure portion is provided that exhibits a desired performance in accordance with a usage, and a shoe including the shoe sole, can be easily manufactured.

DESCRIPTION OF EMBODIMENTS

Figure 1:
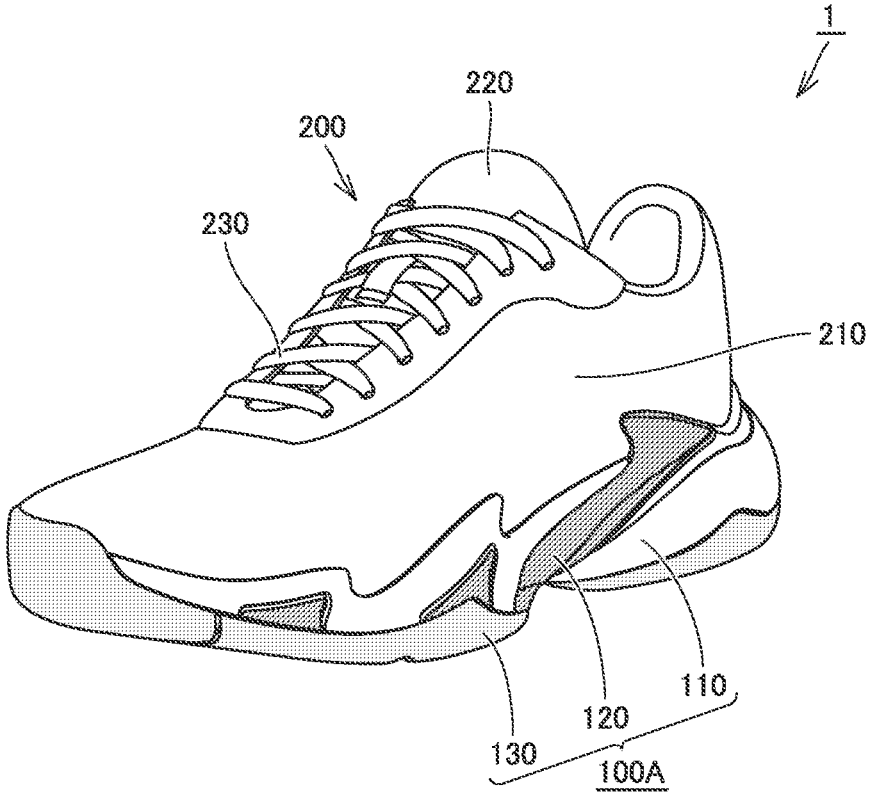
FIG. 1 is a schematic perspective view of a shoe sole and a shoe including the shoe sole relating to Embodiment 1.

Hereinafter, embodiments of the present invention will be described in detail with reference to the figures. Note that, for the embodiments shown below, same or common portions have the same reference numerals attached within the figures, and an explanation of these are not be repeated.

Embodiment 1

FIG. 1 is a schematic perspective view of a shoe sole and a shoe including the shoe sole relating to Embodiment 1. First, a schematic configuration of a shoe 1, and a shoe sole 100A included in the shoe 1, relating to the present embodiment will be described with reference to FIG. 1. Here, in FIG. 1, for ease of understanding, dark coloring is added to a reinforcing structure portion 120, which will be described below, and light coloring is added to an outsole 130, which will be described below (note that, this is the same for FIG. 2 to FIG. 19, which will be described below).

As shown in FIG. 1, the shoe 1 includes the shoe sole 100A and an upper 200. The shoe sole 100A is a member that covers a sole of a foot of a wearer, and has an approximate flat shape. The upper 200 has a bag-type shape that encloses the entire inserted foot of the wearer, and is located above the shoe sole 100A.

The upper 200 has an upper body 210, a shoe tongue 220, and a shoelace 230. The upper body 210 is a member that becomes a base of the upper 200, and has a bag-type shape. The shoe tongue 220 and the shoelace 230 are both fixed or attached to the upper body 210.

A bottom portion fixed to the shoe sole 100A is located on a lower portion of the upper body 210, and an opening portion, where an upper portion of an ankle and a part of the top of the foot are exposed, is provided on an upper portion of the upper body 210. The shoe tongue 220 is fixed, by sewing, welding, bonding, or a combination thereof, to the upper body 210 so as to cover a portion of the opening portion provided in the upper body 210 where the top part of the foot is exposed. Woven or knitted fabric, synthetic leather, resin or the like is used, for example, as the upper body 210 and the shoe tongue 220, and a double raschel warp knitted fabric with a polyester yarn knitted therein is used for a shoe that is required, in particular, to be air permeable and lightweight.

The shoelace 230 is a string-type member for pulling together peripheral edges of the opening portion, where a part of the top of the foot is exposed, provided in the upper body 210, in a foot width direction, and is passed through a plurality of hole portions provided on the peripheral edges of the opening portion. The shoelace 230 is tightened in a state where the foot of the wearer is inserted into the upper body 210, and the upper body 210 and the shoe tongue 220 can be brought into close contact with the foot.

The shoe sole 100A has a midsole 110, a reinforcing structure portion 120, and an outsole 130, and the midsole 110 from among these corresponds to a sole body. The midsole 110, the reinforcing structure portion 120, and the outsole 130 are integrated with each other, thereby the shoe sole 100A has an overall approximate flat shape, such as stated above.

The outsole 130 has a ground contact surface 131 (refer to FIG. 2 to FIG. 7) on the lower surface thereof, and the midsole 110 is located above the outsole 130. Moreover, the reinforcing structure portion 120 has a part thereof embedded in the midsole 110, and another part located to be exposed from the midsole 110.

Figure 2:
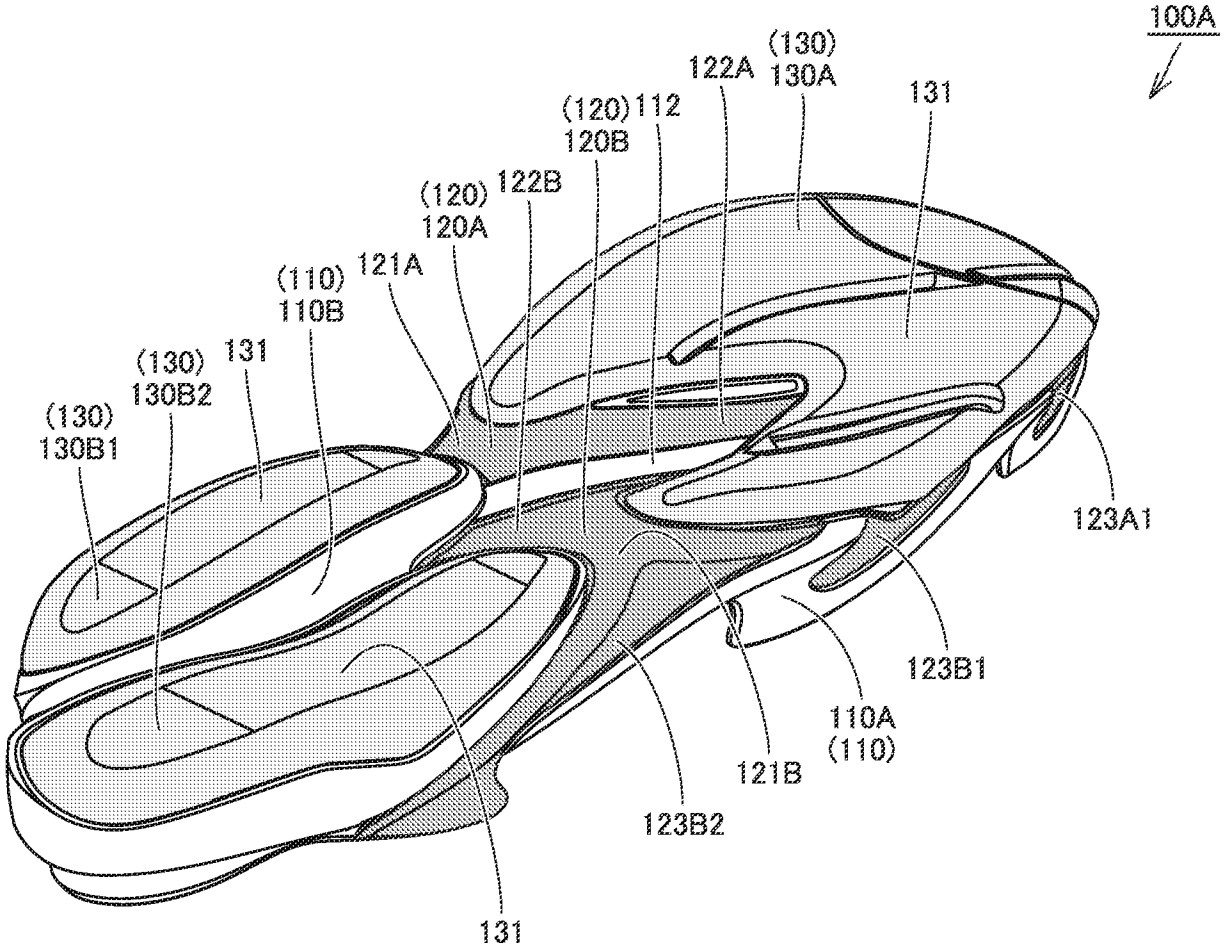
FIG. 2 is a perspective view of the shoe sole shown in FIG. 1.
Figure 3:
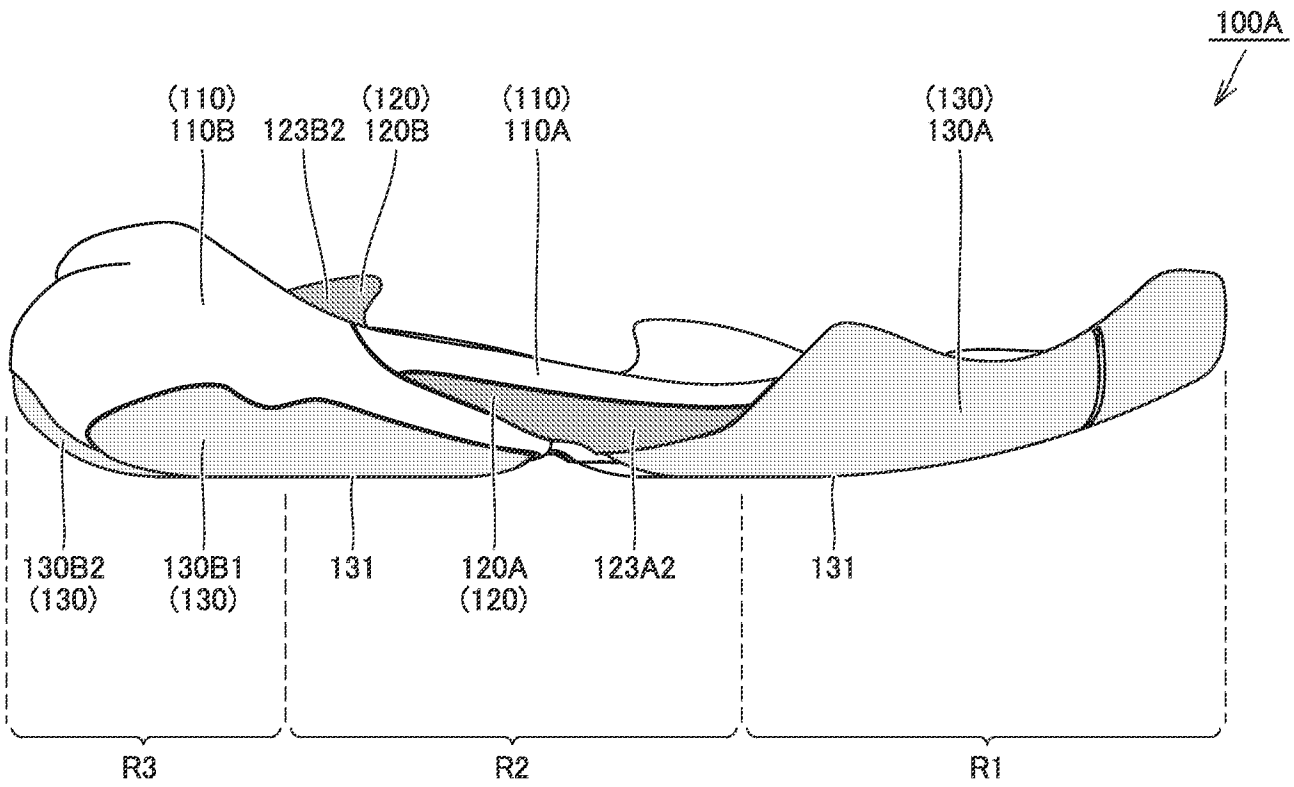
FIG. 3 is a side surface view on a medial foot side of the shoe sole shown in FIG. 1.
Figure 4:
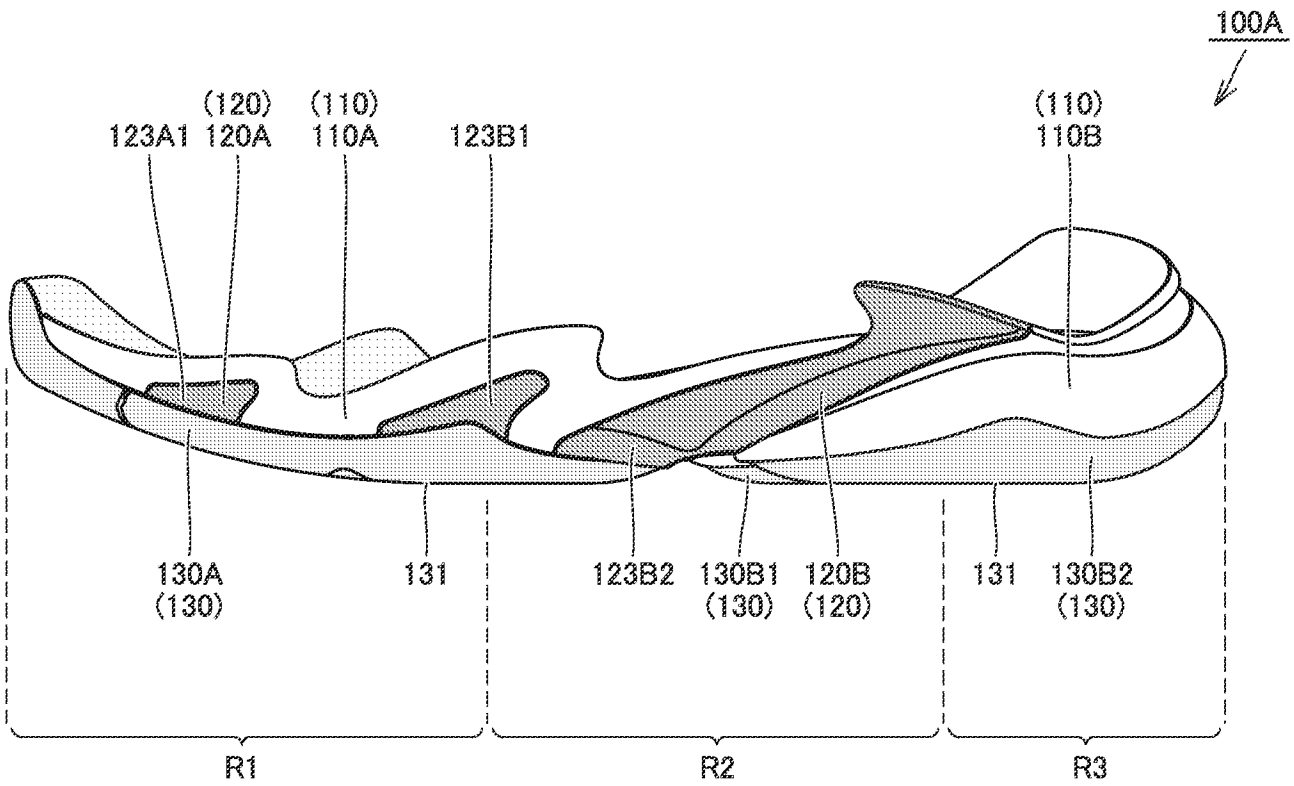
FIG. 4 is a side surface view on a lateral foot side of the shoe sole shown in FIG. 1.
Figure 5:
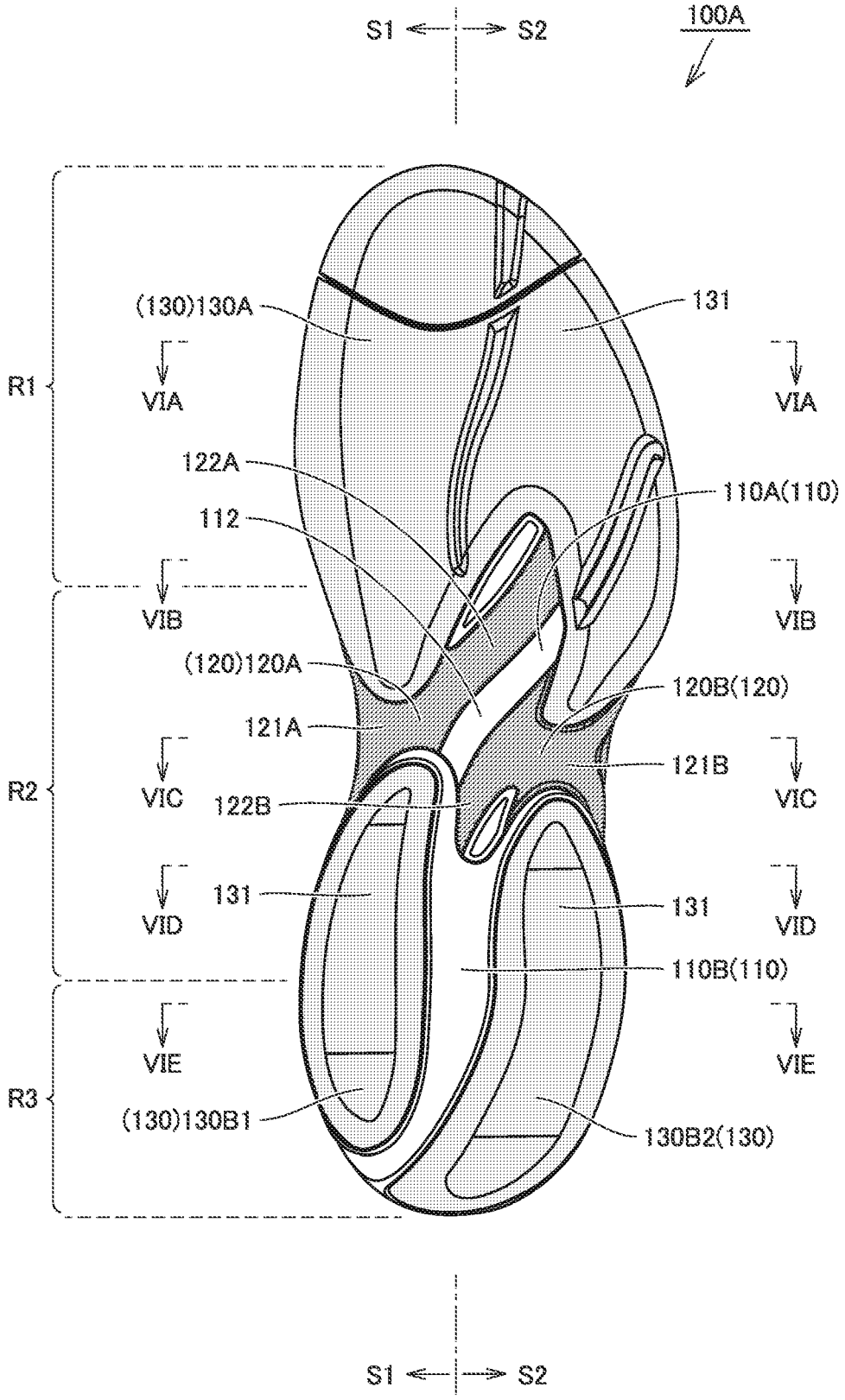
FIG. 5 is a bottom surface view of the shoe sole shown in FIG. 1.
Figure 7:
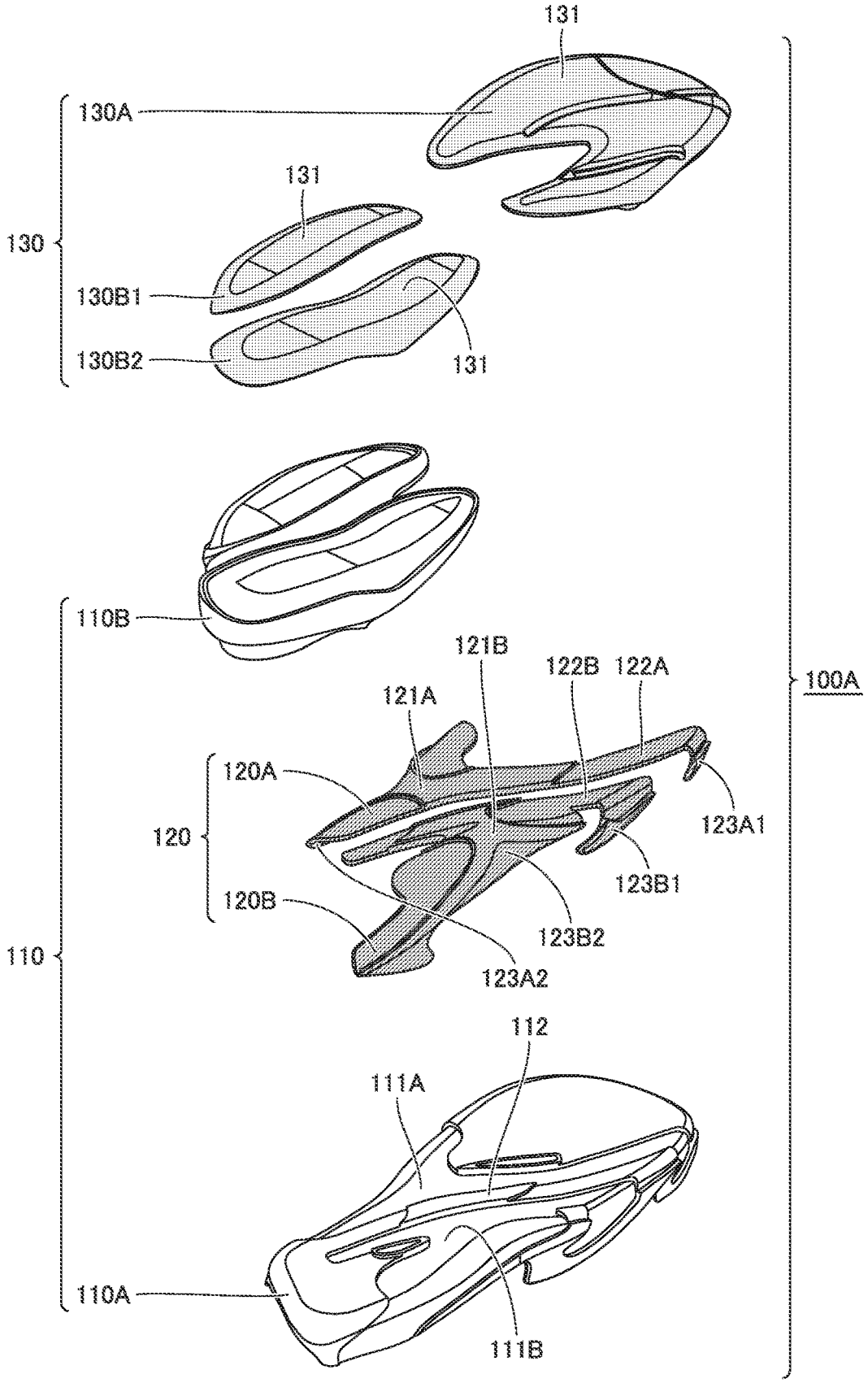
FIG. 7 is an exploded perspective view of the shoe sole shown in FIG. 1.
Figure 8:
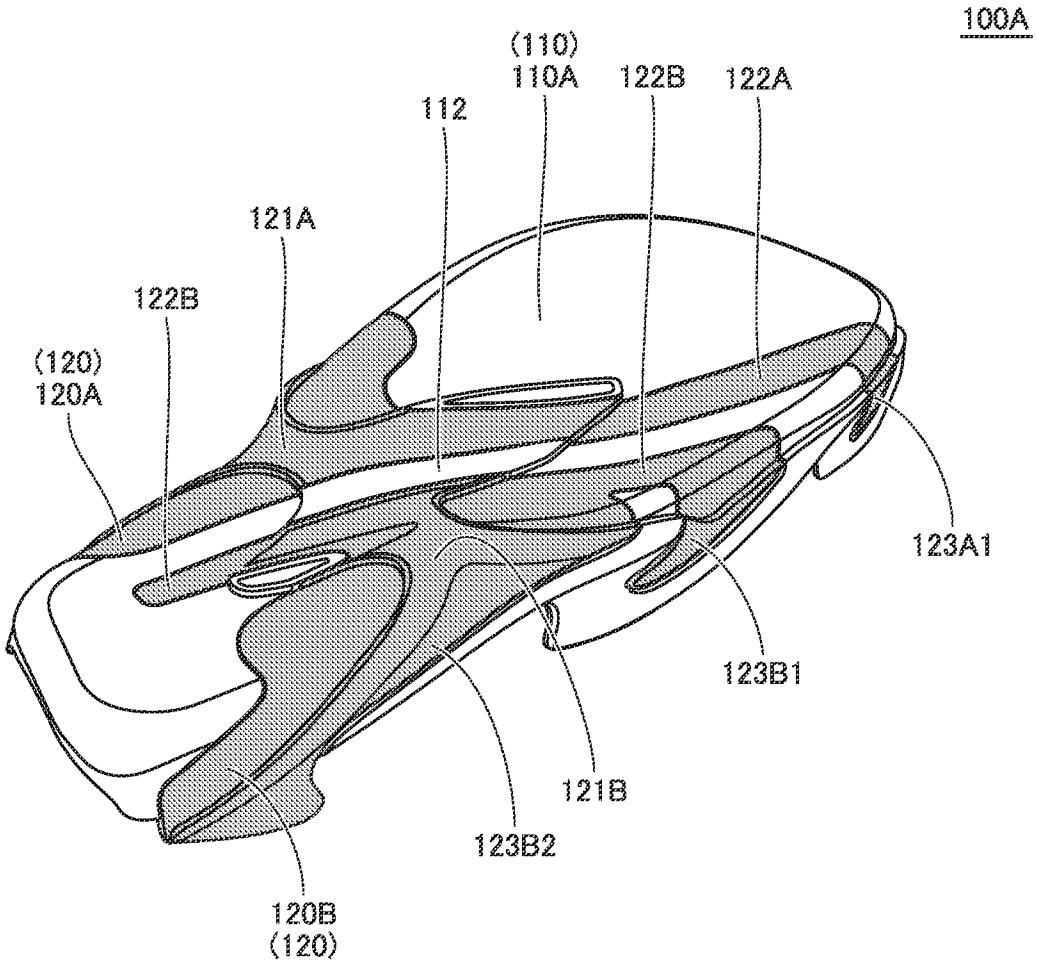
FIG. 8 is a perspective view showing a state where an outsole and a rear side midsole are removed from the shoe sole shown in FIG. 1.
Figure 9:
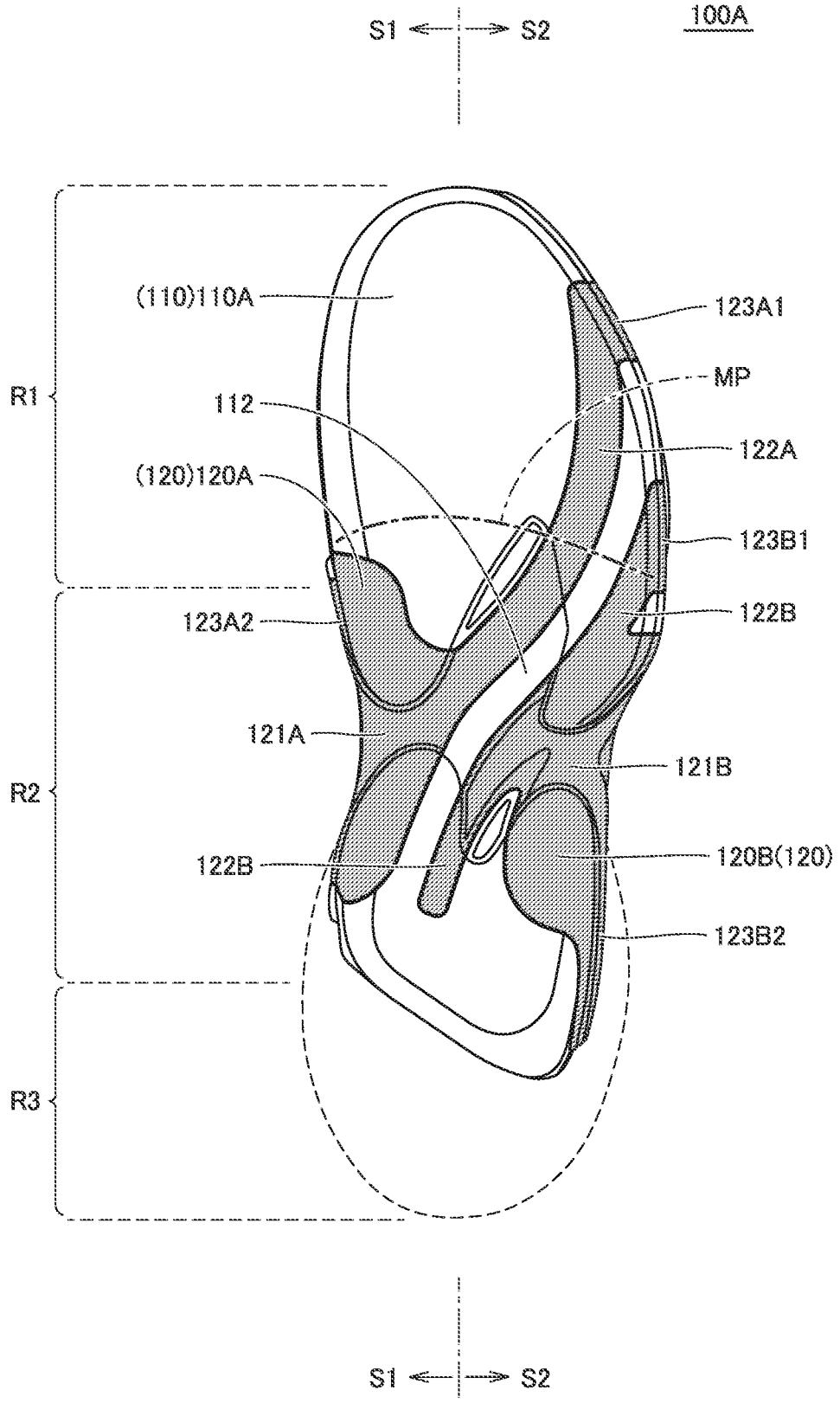
FIG. 9 is a bottom surface view showing a state where an outsole and a rear side midsole are removed from the shoe sole shown in FIG. 1.

FIG. 2 is a perspective view of the shoe sole shown in FIG. 1, and FIG. 3 and FIG. 4 are a side surface view on a medial foot side and a side surface view on a lateral foot side, respectively, of the shoe sole shown in FIG. 1. FIG. 5 is a bottom surface view of the shoe sole shown in FIG. 1, and FIG. 6(A) to FIG. 6(E) are cross-section views along a VIA-VIA line to a VIE-VIE line, respectively, shown in FIG. 5. Moreover, FIG. 7 is an exploded perspective view of the shoe sole shown in FIG. 1, and FIG. 8 and FIG. 9 are a perspective view and a bottom surface view, respectively, showing a state where an outsole and a rear side midsole are removed from the shoe sole shown in FIG. 1. Next, a detailed structure of the shoe sole 100A relating to the present embodiment will be described with reference to FIG. 2 to FIG. 9.

As shown in FIG. 3 to FIG. 5, the shoe sole 100A is divided into a forefoot portion R1 for supporting a toe portion and a ball portion of the foot of the wearer, a midfoot portion R2 for supporting an arch portion of the foot of the wearer, and a rearfoot portion R3 for supporting a heel portion of the foot of the wearer, along a front-rear direction (left-right direction in the figures in FIG. 3 and FIG. 4, up-down direction in the figure in FIG. 5) that is a direction coinciding with a foot length direction of the foot of the wearer in a plan view state.

Here, in the case where a front side end of the shoe sole 100A is set as a reference, a location corresponding to a dimension of 40% of a dimension of the shoe sole 100A in a front-rear direction from the front side end is set as a first boundary location, and a location corresponding to a dimension of 80% of a dimension of the shoe sole 100A in the front-rear direction from the front side end is set as a second boundary location, the forefoot portion R1 corresponds to a portion included between the front side end and the first boundary location along the front-rear direction, the midfoot portion R2 corresponds to a portion included between the first boundary location and the second boundary location along the front-rear direction, and the rearfoot portion R3 corresponds to a portion included between the second boundary location and a rear side end of the shoe sole along the front-rear direction.

Moreover, as shown in FIG. 5, the shoe sole 100A is divided into a portion on a medial foot side (portion on the S1 side shown in the figure) that is a medial side of the foot in an anatomical position (namely, a side close to a midline), and a portion on a lateral foot side (portion on the S2 side shown in the figure) that is on an opposite side to the medial side of the foot in an anatomical position (namely, a side away from the midline), along a left-right direction (left-right direction in the figure) that is a direction coinciding with a foot width direction of the foot of the wearer in a plan view state. Here, a boundary line dividing the shoe sole 100A into the portion on the medial foot side and the portion on the lateral foot side is a so-called shoe center. This shoe center, in the case where a standard wearer having a foot with a size suitable for the shoe 1 wears the shoe, is a straight line that can be obtained in the case where a straight line connecting a portion between a first toe and a second toe of the wearer and a calcaneal center portion is projected onto the shoe sole 100A along the up-down direction.

With reference to FIG. 2 to FIG. 7, the shoe sole 100A has the midsole 110, the reinforcing structure portion 120, and the outsole 130, such as stated above. The midsole 110 has an upper surface, a lower surface, and a side surface connecting the upper surface and the lower surface, and forms a portion of the shoe sole 100A on an upper portion side. The outsole 130 has an upper surface, and a lower surface as the ground contact surface 131 such as stated above, and forms a portion of the shoe sole 100A on a lower portion side. On the other hand, the reinforcing structure portion 120 is located so that a large portion thereof covers the lower surface of the midsole 110.

The midsole 110 is located continuously from the forefoot portion R1 to the rearfoot portion R3. The midsole 110 includes a front side midsole 110A and a rear side midsole 110B, and is formed by combining the front side midsole 110A and the rear side midsole 110B. The front side midsole 110A is located straddling across the forefoot portion R1, the midfoot portion R2, and a portion near the front end of the rearfoot portion R3, and the rear side midsole 110B is located straddling across a portion near the rear end of the midfoot portion R2, and the rearfoot portion R3.

Here, in a portion between the portion near the rear end of the midfoot portion R2 and the portion near the front end of the rearfoot portion R3, the rear end portion of the front side midsole 110A and the front end portion of the rear side midsole 110B are overlapping in an up-down direction (namely, a direction orthogonal to both the above-stated front-rear direction and left-right direction) (in particular, refer to FIG. 6(D), FIG. 6(E), and FIG. 7). In more detail, in this portion, the front side midsole 110A and the rear side midsole 110B are overlapping, so that the front side midsole 110A is located on the upper 200 side and the rear side midsole 110B is located on the outsole 130 side.

In this way, in the forefoot portion R1 and the portion near the front end of the midfoot portion R2, the midsole 110 is formed by the front side midsole 110A, in the portion near the rear end of the midfoot portion R2 and the portion near the front end of the rearfoot portion R3, the midsole 110 is formed by the overlapping portions of the front side midsole 110A and the rear side midsole 110B, and in the portion near the rear end of the rearfoot portion R3, the midsole 110 is formed by the rear side midsole 110B.

Figure 6:
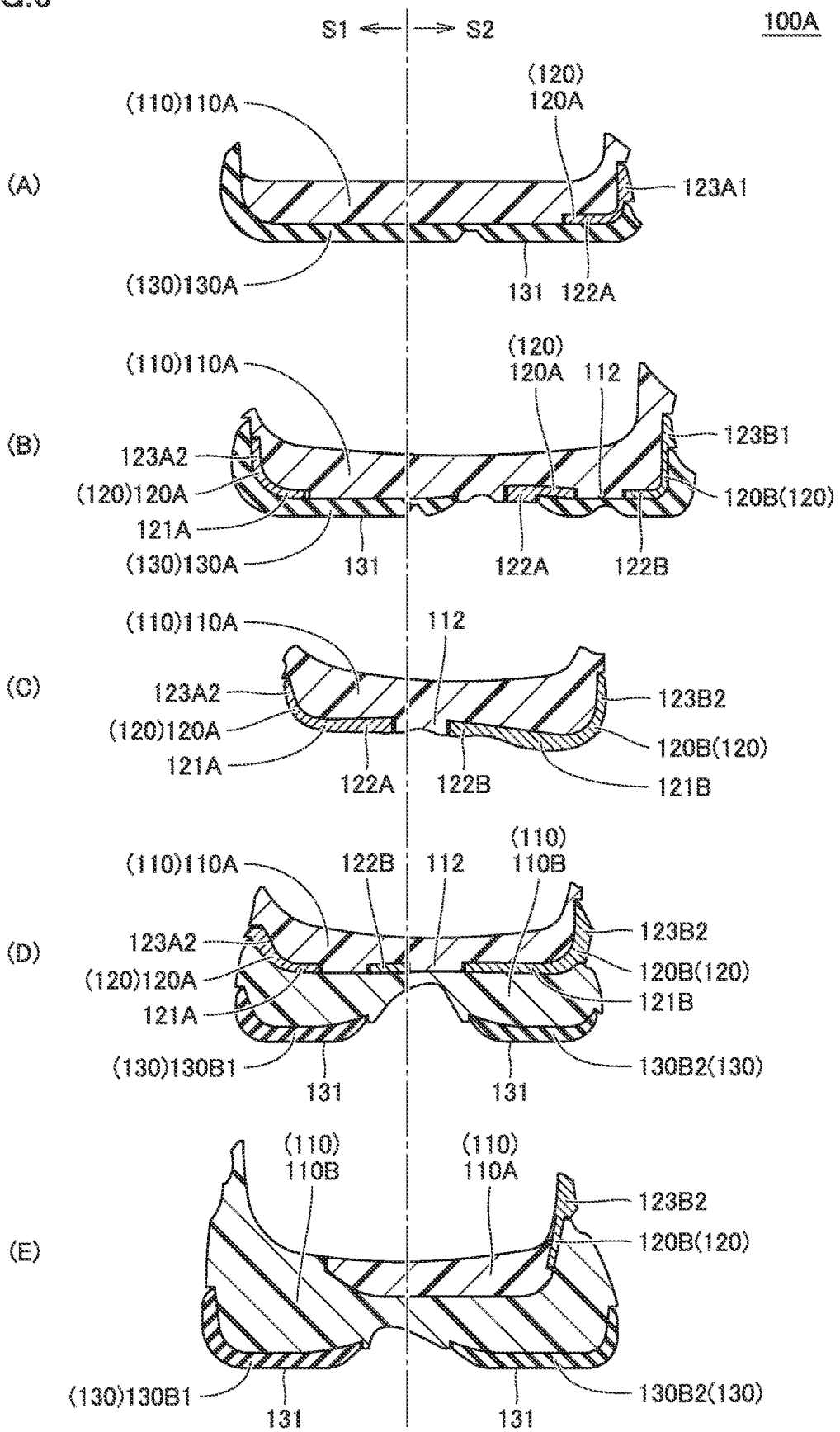
FIG. 6A, FIG. 6B and FIG. 6C are cross-section views of the shoe sole shown in FIG. 1.

The upper surface of the midsole 110 prescribes an upper surface of the shoe sole 100A, and the peripheral edge thereof has a protruding shape compared to the surroundings (in particular, refer to FIG. 3, FIG. 4, and FIG. 6). In this way, a concave-shaped portion is provided on the upper surface of the midsole 110, and this concave-shaped portion becomes a portion in which the upper 200 is received. The portion on the upper surface of the midsole 110, other than the peripheral edge that is a bottom surface of this concave-shaped portion, has a smooth curved surface shape so as to fit the sole of the wearer.

The outsole 130, apart from a part of the midfoot portion R2, is located continuously from roughly the forefoot portion R1 to the rearfoot portion R3. The outsole 130 includes a front side outsole 130A, a rear medial foot side outsole 130B1, and a rear lateral foot side outsole 130B2. The front side outsole 130A is located straddling across the forefoot portion R1 and the portion near the front end of the midfoot portion R2, and the rear medial foot side outsole 130B1 and the rear lateral foot side outsole 130B2 are each located straddling across the portion near the rear end of the midfoot portion R2 and the rearfoot portion R3. The rear medial foot side outsole 130B1 is located at a portion on the medial foot side from among the portion near the rear end of the midfoot portion R2 and the rearfoot portion R3, and the rear lateral foot side outsole 130B2 is located at a portion on the lateral foot side from among the portion near the rear end of the midfoot portion R2 and the rearfoot portion R3.

Since the lower surface of each of the front side outsole 130A, the rear medial foot side outsole 130B1, and the rear lateral foot side outsole 130B2 (namely, the lower surface of the outsole 130) forms the ground contact surface 131 such as stated above, in order to improve the grip performance, a tread pattern may be formed by having protrusions and recesses formed on an exposed surface thereof. Each of the front side outsole 130A, the rear medial foot side outsole 130B1, and the rear lateral foot side outsole 130B2 has an upper surface thereof joined to the lower surface of the midsole 110.

It is preferable that the midsole 110 (namely, the front side midsole 110A and the rear side midsole 110B) is excellent in a shock absorbing performance while having a suitable strength, and from this viewpoint, for example, a foam material made of resin, which includes a resin material as a main component and a foaming agent and a crosslinking agent as secondary components, is used as the midsole 110. Moreover, instead of this, a foam material made of rubber, which includes a rubber material as a main component and a plasticizer, a foaming agent, a reinforcing agent, and a crosslinking agent as secondary agents, may be used.

An ethylene-vinyl acetate copolymer (EVA), a polyolefin resin, a thermoplastic polyurethane, a thermoplastic polyamide elastomer (TPA, TPAE), or a thermoplastic polyester elastomer can be used, for example, as the resin material. Butadiene rubber can be suitably used, for example, as the rubber material.

In this way, the midsole 110 is generally formed by a member with a lower Young's modulus and more flexible than the outsole 130. Note that, various types of shock absorbing parts may be included, and reinforcing parts other than the reinforcing structure portion 120, which will be described below, may be included, at prescribed portions of the midsole 110.

It is preferable that the outsole 130 (namely, the front side outsole 130A, the rear medial foot side outsole 130B1, and the rear lateral foot side outsole 130B2) is excellent in wear resistance and grip performance, and from this viewpoint, a member made of a material, which includes a rubber material as a main component and a plasticizer, a reinforcing agent, and a crosslinking agent as secondary agents, is used, for example, as the outsole 130. Butadiene rubber can be suitably used, for example, as the rubber material.

In this way, the outsole 130 is generally formed by a member with a higher Young's modulus and harder than the midsole 110. Note that, the shape of the outsole 130 and the above-stated tread pattern can be appropriately designed in accordance with a usage of the shoe 1.

As shown in FIG. 2 to FIG. 9, the reinforcing structure portion 120 is disposed so that a large portion thereof is located on the midfoot portion R2, while one part thereof reaches the forefoot portion R1 and the rearfoot portion R3. The reinforcing structure portion 120 includes a first reinforcing member 120A and a second reinforcing member 120B. The first reinforcing member 120A and the second reinforcing member 120B are made of different members. The first reinforcing member 120A is located on the medial foot side from the second reinforcing member 120B, and the second reinforcing member 120B is located on the lateral foot side from the first reinforcing member 120A.

The first reinforcing member 120A and the second reinforcing member 120B are each made of a material higher in rigidity than the material forming the midsole 110. Namely, the first reinforcing member 120A and the second reinforcing member 120B have a higher Young's modulus and are harder than the midsole 110.

While the material forming the first reinforcing member 120A and the second reinforcing member 120B is not particularly limited, a non-fiber reinforced resin made of a polymer resin such as urethane-based thermoplastic elastomer (TPU), amide-based thermoplastic elastomer (TPA), ethylene-vinyl acetate copolymer (EVA) or the like, or a fiber reinforced resin using carbon fibers, glass fibers, aramid fibers, Dyneema fibers, Zylon fibers, boron fibers or the like as reinforcing fibers, for example, can be suitably used.

In addition to this, the first reinforcing member 120A and the second reinforcing member 120B may be made of rubber, or may be a same type of material as the material forming the midsole 110, with the condition that the rigidity is higher than the midsole 110. Note that, while forming the first reinforcing member 120A and the second reinforcing member 120B with a same type of material as the midsole 110, it is assumed that the density is higher, for example, as a method of having the rigidity of these members higher than the midsole 110.

The first reinforcing member 120A is formed from an approximate plate shaped member having a prescribed thickness, and has a first base 121A, a first bar 122A, a lateral foot side first rising wall 123A1, and a medial foot side first rising wall 123A2.

The first base 121A is located at a portion of the midfoot portion R2 on the medial foot side, and extends in roughly the front-rear direction along an edge portion of the front side midsole 110A on the medial foot side at a portion corresponding to the midfoot portion R2. The first base 121A has an approximate plate shape that covers a lower surface of the front side midsole 110A.

The first bar 122A has an elongated approximate plate shape that covers the lower surface of the front side midsole 110A, and is disposed so as to reach a portion near the rear end of the midfoot portion R2 on the medial foot side from a portion near the front end of the forefoot portion R1 on the lateral foot side. In this way, the portion of the first bar 122A disposed in the midfoot portion R2 extends along an oblique direction crossing both the front-rear direction and the left-right direction, such that a front end thereof is located on the lateral foot side and a rear end thereof is located on the medial foot side.

The rear end portion of the first bar 122A is connected to the first base 121A. In other words, the first bar 122A is provided so as to extend continuously from the first base 121A.

The lateral foot side first rising wall 123A1, which has an approximate plate shape, is provided on the front end portion of the first bar 122A. The lateral foot side first rising wall 123A1 is erected along a side surface of the front side midsole 110A on the lateral foot side from the front end portion of the first bar 122A. In this way, the lateral foot side first rising wall 123A1 covers a part of the side surface of the midsole 110 on the lateral foot side.

The medial foot side first rising wall 123A2, which has an approximate plate shape, is provided on the end portion of the first base 121A on the medial foot side. The medial foot side first rising wall 123A2 is erected along a side surface of the front side midsole 110A on the medial foot side from the end portion of the first base 121A on the medial foot side. In this way, the medial foot side first rising wall 123A2 covers a part of the side surface of the midsole 110 on the medial foot side.

The first reinforcing member 120A formed of the above-stated first base 121A, first bar 122A, lateral foot side first rising wall 123A1, and medial foot side first rising wall 123A2 is connected to the lower surface and the side surface of the front side midsole 110A. Note that, in the present embodiment, a concave shaped first housing portion 111A (refer to FIG. 7), which has a shape corresponding to the first reinforcing member 120A, is formed on the lower surface and the side surface of the front side midsole 110A, and the first reinforcing member 120A is connected to the front side midsole 110A and the rear side midsole 110B in a state where housed in this first housing portion 111A.

The second reinforcing member 120B is formed from an approximate plate shaped member having a prescribed thickness, and has a second base 121B, a second bar 122B, a front side second rising wall 123B1, and a rear side second rising wall 123B2.

The second base 121B is located at a portion of the midfoot portion R2 on the lateral foot side, and extends in roughly the front-rear direction along an edge portion of the front side midsole 110A on the lateral foot side at a portion corresponding to the midfoot portion R2. The second base 121B has an approximate plate shape that covers a lower surface of the front side midsole 110A.

The second bar 122B has an elongated approximate plate shape that covers the lower surface of the front side midsole 110A, and is disposed so as to reach a portion near the rear end of the midfoot portion R2 on the medial foot side from a portion near the rear end of the forefoot portion R1 on the lateral foot side. In this way, the portion of the second bar 122B disposed in the midfoot portion R2 extends along an oblique direction crossing both the front-rear direction and the left-right direction, such that a front end thereof is located on the lateral foot side and a rear end thereof is located on the medial foot side.

An intermediate portion excluding the front end portion and the rear end portion of the second bar 122B is connected to the second base 121B. In other words, the second bar 122B is provided so as to extend continuously from the second base 121B.

The front side second rising wall 123B1, which has an approximate plate shape, is provided on the front end portion of the second bar 122B. The front side second rising wall 123B1 is erected along a side surface of the front side midsole 110A on the lateral foot side from the front end portion of the second bar 122B. In this way, the front side second rising wall 123B1 covers a part of the side surface of the midsole 110 on the lateral foot side.

The rear side second rising wall 123B2, which has an approximate plate shape, is provided on the end portion of the second base 121B on the lateral foot side. The rear side second rising wall 123B2 is erected along a side surface of the front side midsole 110A on the lateral foot side from the end portion of the second base 121B on the lateral foot side. In this way, the rear side second rising wall 123B2 covers a part of the side surface of the midsole 110 on the lateral foot side.

The second reinforcing member 120B formed of the above-stated second base 121B, second bar 122B, front side second rising wall 123B1, and rear side second rising wall 123B2 is connected to the lower surface and the side surface of the front side midsole 110A. Note that, in the present embodiment, a concave shaped second housing portion 111B (refer to FIG. 7), which has a shape corresponding to the second reinforcing member 120B, is formed on the lower surface and the side surface of the front side midsole 110A, and the second reinforcing member 120B is connected to the front side midsole 110A and the rear side midsole 110B in a state where housed in this second housing portion 111B.

Here, the first bar 122A of the first reinforcing member 120A and the second bar 122B of the second reinforcing member 120B are disposed with a distance therebetween in the front-rear direction and the left-right direction. In this way, the first bar 122A and the second bar 122B are located with a distance therebetween, in particular, in the midfoot portion R2.

Accordingly, an interposed portion 112, which is formed by a part of the midsole 110 (more strictly, a part of the front side midsole 110A) made of a material lower in rigidity than the first reinforcing member 120A and the second reinforcing member 120B, is located at a portion between the first bar 122A and the second bar 122B, in particular, in the midfoot portion R2. This interposed portion 112 is a part of the midsole 110 at a portion where the reinforcing structure portion 120 is not provided.

This interposed portion 112 extends along a same direction as the direction in which the first bar 122A and the second bar 122B extend. In more detail, the portion of the interposed portion 112 disposed in the midfoot portion R2 extends along an oblique direction crossing both the front-rear direction and the left-right direction, such that a front end thereof is located on the lateral foot side and a rear end thereof is located on the medial foot side.

As shown in FIG. 7, in the shoe sole 100A relating to the present embodiment, the above-stated first reinforcing member 120A and second reinforcing member 120B are assembled on the front side midsole 110A, prior to the front side midsole 110A and the rear side midsole 110B being combined. Accordingly, after the rear side midsole 110B is assembled with the front side midsole 110A, it becomes a state where the portion of the rear end portion of the first reinforcing member 120A excluding the medial foot side first rising wall 123A2, and the portion of the rear end portion of the second reinforcing member 120B excluding the rear side second rising wall 123B2, are sandwiched by the front side midsole 110A and the rear side midsole 110B, such as shown in FIG. 6(D) and FIG. 6(E), and these portions are embedded in the midsole 110, thereby no longer being exposed to the outside.

Moreover, the rear end portion of the interposed portion 112 of the front side midsole 110A, which is located between the first bar 122A of the first reinforcing member 120A and the second bar 122B of the second reinforcing member 120B, is covered by the rear side midsole 110B, such as shown in FIG. 6(D), and this portion is no longer exposed to the outside.

In addition, as shown in FIG. 7, in the shoe sole 100A relating to the present embodiment, after the rear side midsole 110B is assembled with the front side midsole 110A, the front side outsole 130A, the rear medial foot side outsole 130B1, and the rear lateral foot side outsole 130B2 are respectively assembled with the midsole 110. In this way, it becomes a state where the portion of the front end part of the first reinforcing member 120A excluding the lateral foot side first rising wall 123A1, and the portion of the front end portion of the second reinforcing member 120B excluding the front side second rising wall 123B1, are sandwiched by the front side midsole 110A and the front side outsole 130A, such as shown in FIG. 6(A) and FIG. 6(B), and these portions are no longer exposed to the outside.

Moreover, the front end portion of the interposed portion 112 of the front side midsole 110A, which is located between the first bar 122A of the first reinforcing member 120A and the second bar 122B of the second reinforcing member 120B, is covered by the front side outsole 130A, such as shown in FIG. 6(B), and this portion is no longer exposed to the outside.

Note that, while the connections between each of the front side midsole 110A, the rear side midsole 110B, the first reinforcing member 120A, the second reinforcing member 120B, the front side outsole 130A, the rear medial foot side outsole 130B1, and the rear lateral foot side outsole 130B2 may be performed by any type of method, they can be performed, for example, by adhesion or the like.

In the above-described shoe 1 and the shoe sole 100A included in the shoe 1 relating to the present embodiment, the portions of the first bar 122A and the second bar 122B disposed in the midfoot portion R2 extend along an oblique direction crossing both the front-rear direction and the left-right direction, such that a front end thereof is located on the lateral foot side and a rear end thereof is located on the medial foot side, and the portions of the first bar 122A and the second bar 122B disposed in the midfoot portion R2 are located with a distance therebetween. In this way, the interposed portion 112 formed from a part of the midsole 110 is disposed between the first bar 122A and the second bar 122B.

Accordingly, by being formed in such a manner, twisting easily occurs between a portion of the forefoot portion R1 on the medial foot side and a portion of the rearfoot portion R3 on the lateral foot side, around an axis in a direction where the interposed portion 112 extends, at the location where the interposed portion 112 is provided. Therefore, in association with this, an impulse of brake at the time of a cutting maneuver increases, and as a result, a swift and smooth cutting maneuver can be realized.

Moreover, by being formed in such a manner, the first bar 122A and the second bar 122B are disposed extending in a direction crossing the left-right direction. Therefore, a bending stiffness against dorsal flexion of the shoe sole 100A around an axis in the left-right direction also increases, and as a result of this, a function for assisting a start-off at the time of a cutting maneuver (namely, an acceleration assisting function), and a function for increasing a propulsive force to the front at the time of traveling (namely, a travel assisting function), also improve.

In addition, by being formed in such a manner, the first bar 122A and the second bar 122B are disposed in the midfoot portion R2, thereby arch sinking can be prevented by having the arch portion of the foot of the wearer supported by the first bar 122A and the second bar 122B, and a function for maintaining an arch of the foot of the wearer is exhibited.

In addition, as stated above, the reinforcing structure portion 120 is formed by being divided into the first reinforcing member 120A that includes the first bar 122A and the second reinforcing member 120B that includes the second bar 122B, thereby it becomes possible to easily adjust the performance, compared to the case where the reinforcing structure portion 120 is made of a single member. Namely, in the case where the reinforcing structure portion 120 is made of a single member, it becomes difficult to provide an extreme rigidity difference, for example, between the medial foot side and the lateral foot side. Therefore, this reinforcing structure portion 120 is formed by being divided into the first reinforcing member 120A and the second reinforcing member 120B, which are different members, thereby an adjustment of providing such an extreme rigidity difference between the medial foot side and the lateral foot side can be performed relatively easily.

Moreover, in the case where the reinforcing structure portion 120 is made of a single member, a part of the reinforcing structure portion 120 (namely, a connection portion or the like that connects the first bar 122A and the second bar 122B) is naturally included in the portion that becomes the above-stated axis of twisting. Therefore, the reinforcing structure portion 120 is formed by being dividing into the first reinforcing member 120A and the second reinforcing member 120B, which are different members, thereby it becomes possible to be formed so that the reinforcing structure portion 120 is not located in the portion that becomes an axis of twisting, an adjustment of the performance is simplified for this point, and by extension, a swift and smooth cutting maneuver is further promoted.

Therefore, by having the shoe 1 and the shoe sole 100A included in the shoe 1 relating to the present embodiment, it becomes possible to easily manufacture a shoe sole, in which a reinforcing structure portion is provided that exhibits a desired performance in accordance with a usage, and a shoe including the shoe sole. In addition, in the case of having the shoe 1 and the shoe sole 100A included in the shoe 1 relating to the present embodiment, it is possible to individually provide changes to the performance of the reinforcing structure portion in accordance with not only a usage, by also by the wearer, and a shoe sole and shoe superior to a conventional shoe sole and shoe can be produced for this point.

Here, in the shoe 1 and the shoe sole 100A included in the shoe 1 relating to the present embodiment, the first bar 122A and the second bar 122B are both provided so that a front end thereof reaches the forefoot portion R1, and the portions of the first bar 122A and second bar 122B located in the forefoot portion R1 both extend crossing a portion corresponding to a metatarsophalangeal joint of the foot of the wearer (the portion shown by reference character MP within FIG. 9). In the case of being formed in such a manner, a larger propulsive force can be obtained by the resilience of the first bar 122A and the second bar 122B, which elastically deform in accordance with dorsal flexion of the shoe sole 100A at take-off, and thereby the above-stated acceleration assisting function and travel assisting function are further improved.

Moreover, in the shoe 1 and the shoe sole 100A included in the shoe 1 relating to the present embodiment, in addition to the first bar 122A, the first base 121A, lateral foot side first rising wall 123A1, and medial foot side first rising wall 123A2 are provided in the first reinforcing member 120A, and in addition to the second bar 122B, the second base 121B, front side second rising wall 123B1, and rear side second rising wall 123B2 are provided in the second reinforcing member 120B. In the case of being formed in such a manner, the overall strength of the shoe sole 100A is improved, it becomes possible to increase a contact area between the first reinforcing member 120A and second reinforcing member 120B and the midsole 110 and outsole 130, and it becomes possible to increase a connection strength between these members. Therefore, a shoe sole and shoe excellent in durability can be produced.

In addition, in the shoe 1 and the shoe sole 100A included the shoe 1 relating to the present embodiment, the midsole 110 is divided into the front side midsole 110A and the rear side midsole 110B, thereby the portion of the rear end portion of the first reinforcing member 120A excluding the medial foot side first rising wall 123A2, and the portion of the rear end portion of the second reinforcing member 120B excluding the rear side second rising wall 123B2, are embedded in the midsole 110 by being sandwiched by the front side midsole 110A and the rear side midsole 110B. In the case of being formed in such a manner, since the members in this portion are disposed from the ground contact surface 131 side in the order of the outsole 130, the midsole 110, and the reinforcing structure portion 120, a shock absorbing function is maximized.

Note that, in the shoe 1 and the shoe sole 100A included in the shoe 1 relating to the present embodiment, a difference in rigidity between the first bar 122A and the second bar 122B can be provided, by variously modifying the thickness, width, and shape of the first bar 122A, and the thickness, width, and shape of the second bar 122B. Therefore, an optimal design according to a usage of the shoe can be performed, by adjusting these characteristics.

Moreover, in the shoe 1 and the shoe sole 100A included in the shoe 1 relating to the present embodiment, instead of or in addition to modifying the thickness, width, and shape of the first bar 122A, and the thickness, width, and shape of the second bar 122B, the material forming the first reinforcing member 120A and the material forming the second reinforcing member 120B may be different. In the case of being formed in such a manner, a difference in rigidity between the first bar 122A and the second bar 122B can be provided. Therefore, an optimal design according to a usage of the shoe can be performed, by making these material different.

First Modified Example

Figure 10:
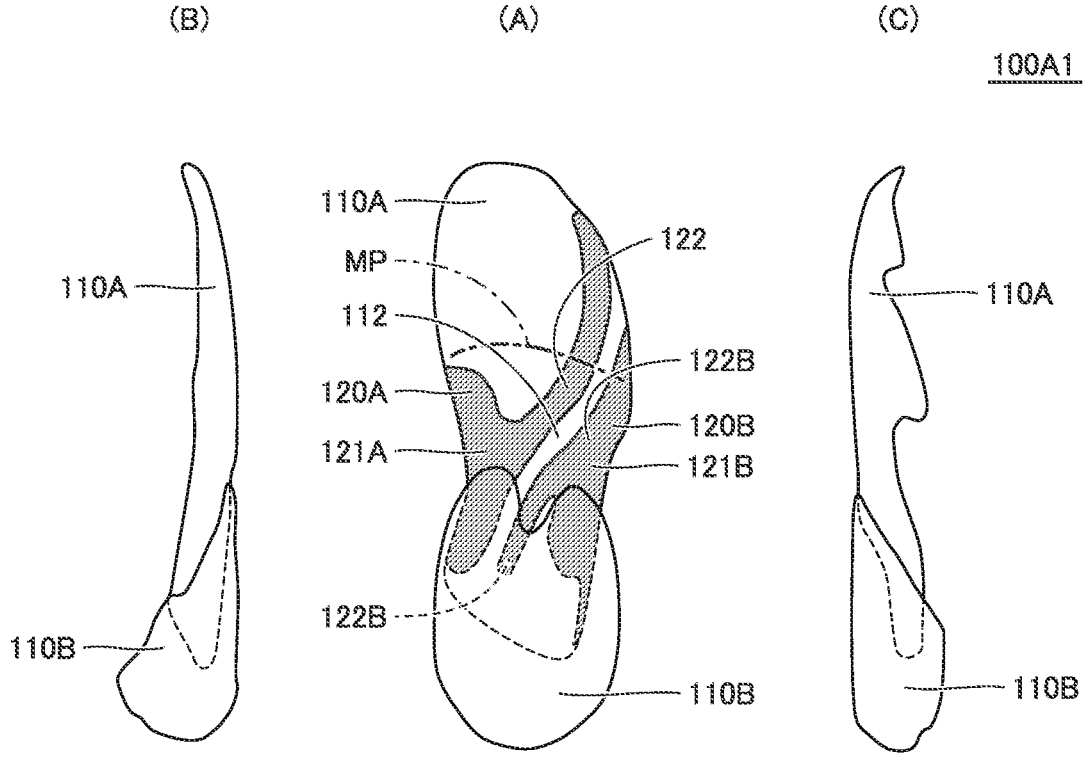
FIG. 10A is a bottom surface view.
FIG. 10B is a side surface view on a medial foot side.
FIG. 10C is a side surface view on a lateral foot side, which omit an illustration of an outsole, of a shoe sole relating to a first modified example.

FIG. 10(A) to FIG. 10(C) show a bottom surface view, a side surface view of a medial foot side, and a side surface view of a lateral foot side, respectively, which omit an illustration of an outsole, of a shoe sole relating to a first modified example. Hereinafter, a shoe sole 100A1 relating to the first modified example based on the above-stated Embodiment 1 will be described, with reference to FIG. 10. Note that, the shoe sole 100A1 relating to this modified example is included in the shoe 1, instead of the shoe sole 100A relating to the above-stated Embodiment 1.

As shown in FIG. 10(A) to FIG. 10(C), the shoe sole 100A1, in the case where compared with the shoe sole 100A relating to the above-stated Embodiment 1, has a configuration that is different for the point of the first reinforcing member 120A does not have the lateral foot side first rising wall 123A1 and the medial foot side first rising wall 123A2, and for the point of the second reinforcing member 120B does not have the front side second rising wall 123B1 and the rear side second rising wall 123B2.

In the case of being formed in such a manner, an effect can be obtained that conforms to the effect described in the above-stated Embodiment 1, in particular, an effect can be obtained where a shoe sole, in which a reinforcing structure portion is provided that exhibits a desired performance in accordance with a usage, and a shoe including the shoe sole, can be easily manufactured.

Second Modified Example

Figure 11:
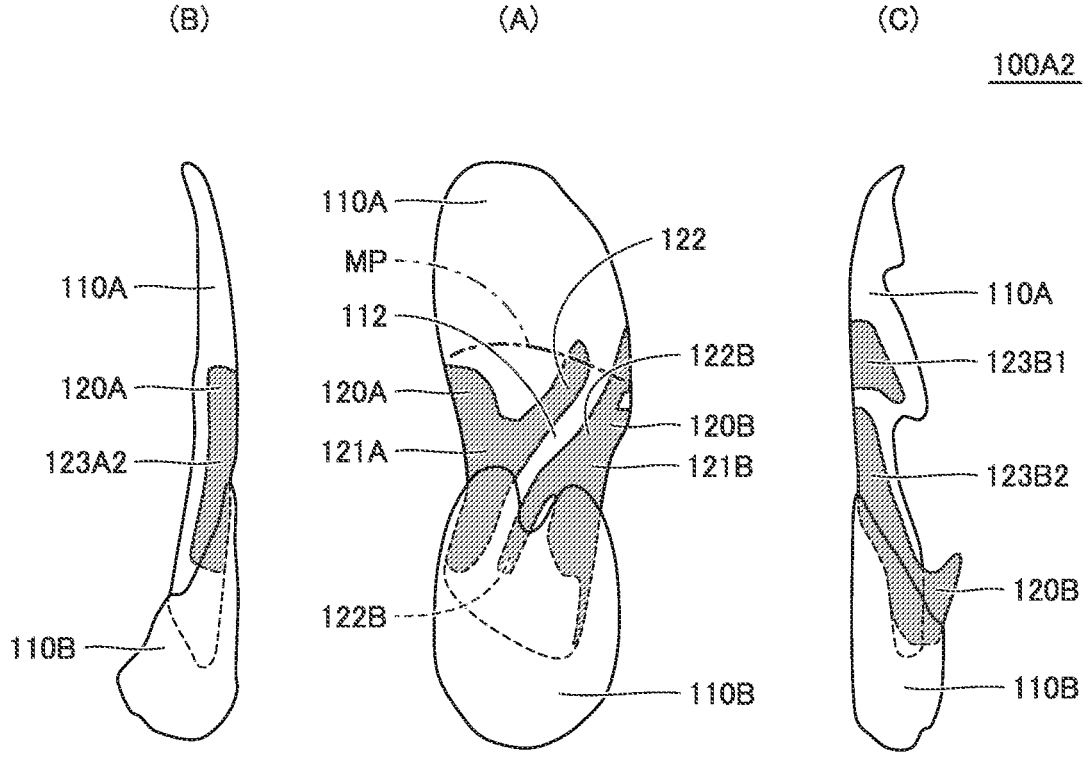
FIG. 11A is a bottom surface view.
FIG. 11B is a side surface view on a medial foot side.
FIG. 11C is a side surface view on a lateral foot side, which omit an illustration of an outsole, of a shoe sole relating to a second modified example.

FIG. 11(A) to FIG. 11(C) show a bottom surface view, a side surface view of a medial foot side, and a side surface view of a lateral foot side, respectively, which omit an illustration of an outsole, of a shoe sole relating to a second modified example. Hereinafter, a shoe sole 100A2 relating to the second modified example based on the above-stated Embodiment 1 will be described, with reference to FIG. 11. Note that, the shoe sole 100A2 relating to this modified example is included in the shoe 1, instead of the shoe sole 100A relating to the above-stated Embodiment 1.

As shown in FIG. 11(A) to FIG. 11(C), the shoe sole 100A2, in the case where compared with the shoe sole 100A relating to the above-stated Embodiment 1, has a configuration that is different mainly for the shape of the first bar 122A included in the first reinforcing member 120A. Specifically, in the shoe sole 100A2, the front end of the first bar 122A is located at a portion near the rear end of the forefoot portion R1 on the lateral foot side, and does not reach the portion near the front end of the forefoot portion R1 on the lateral foot side. In accordance with this, the first reinforcing member 120A does not have the lateral foot side first rising wall 123A1.

In the case of being formed in such a manner, an effect can be obtained that conforms to the effect described in the above-stated Embodiment 1, in particular, an effect can be obtained where a shoe sole, in which a reinforcing structure portion is provided that exhibits a desired performance in accordance with a usage, and a shoe including the shoe sole, can be easily manufactured.

Third Modified Example

Figure 12:
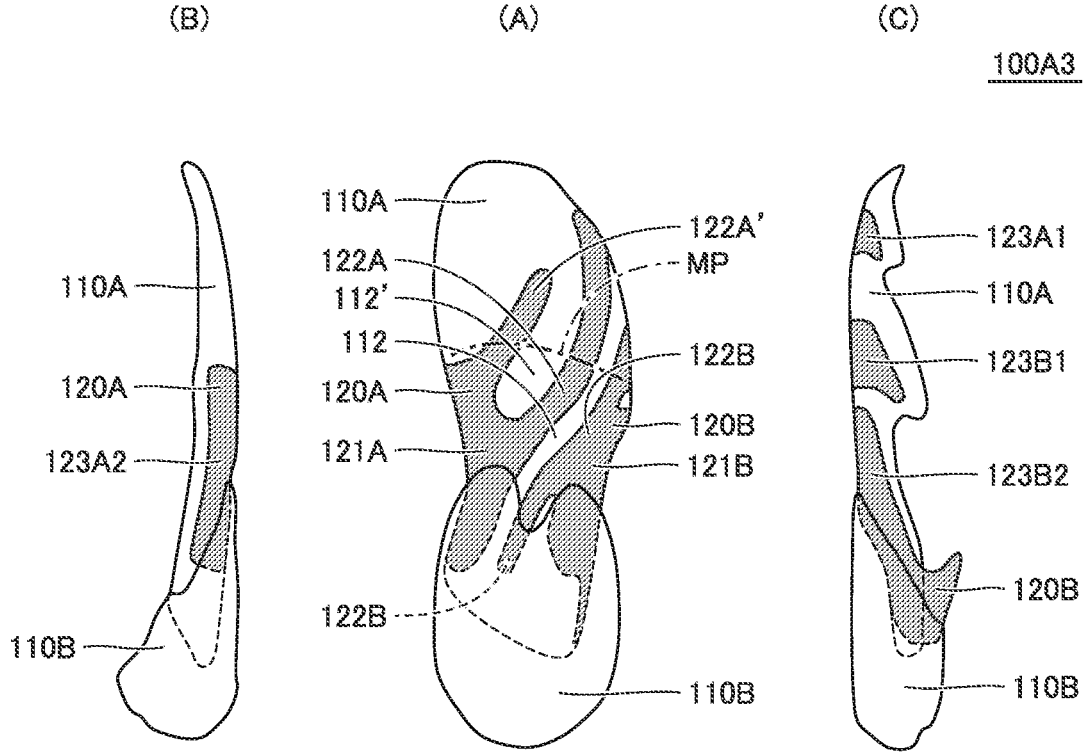
FIG. 12A is a bottom surface view.
FIG. 12B is a side surface view on a medial foot side.
FIG. 12C is a side surface view on a lateral foot side, which omit an illustration of an outsole, of a shoe sole relating to a third modified example.

FIG. 12(A) to FIG. 12(C) show a bottom surface view, a side surface view of a medial foot side, and a side surface view of a lateral foot side, respectively, which omit an illustration of an outsole, of a shoe sole relating to a third modified example. Hereinafter, a shoe sole 100A3 relating to the third modified example based on the above-stated Embodiment 1 will be described, with reference to FIG. 12. Note that, the shoe sole 100A3 relating to this modified example is included in the shoe 1, instead of the shoe sole 100A relating to the above-stated Embodiment 1.

As shown in FIG. 12(A) to FIG. 12(C), the shoe sole 100A3, in the case where compared with the shoe sole 100A relating to the above-stated Embodiment 1, has a configuration that is different mainly for the point of the first reinforcing member 120A has an additional first bar 122A' in addition to the first bar 122A.

Specifically, the additional first bar 122A' has an elongated approximate plate shape that covers the lower surface of the front side midsole 110A, and is disposed so as to reach a portion near the front end of the midfoot portion R2 on the medial foot side from the portion near the front end of the forefoot portion R1 on the lateral foot side. In this way, the portion of the additional first bar 122A' disposed in the midfoot portion R2 extends along an oblique direction crossing both the front-rear direction and the left-right direction, such that a front end thereof is located on the lateral foot side and a rear end thereof is located on the medial foot side. Note that, the additional first bar 122A' is located on the medial foot side from the first bar 122A.

The rear end portion of the additional first bar 122A' is connected to the first base 121A. In other words, the additional first bar 122A' is provided so as to extend continuously from the first base 121A.

Here, the first bar 122A and the additional first bar 122A' of the first reinforcing member 120A are disposed with a distance therebetween in both the front-rear direction and the left-right direction. In this way, the first bar 122A and the additional first bar 122A' are located with a distance therebetween, in particular, in the midfoot portion R2.

Accordingly, an additional interposed portion 112', which is formed by a part of the midsole 110 (more strictly, a part of the front side midsole 110A) made of a material lower in rigidity than the first reinforcing member 120A, is located at a portion between the first bar 122A and the additional first bar 122A', in particular, in the midfoot portion R2. This additional interposed portion 112' is apart of the midsole 110 at a portion where the reinforcing structure portion 120 is not provided.

This additional interposed portion 112' extends along a same direction as the direction in which the first bar 122A and the additional first bar 122A' extend. In more detail, the portion of the additional interposed portion 112' disposed in the midfoot portion R2 extends along an oblique direction crossing both the front-rear direction and the left-right direction, such that a front end thereof is located on the lateral foot side and a rear end thereof is located on the medial foot side.

Accordingly, in the case of being formed in such a manner, twisting easily occurs between a portion of the forefoot portion R1 on the medial foot side and a portion of the rearfoot portion R3 on the lateral foot side, not only around an axis in a direction where the interposed portion 112 extends, but also around an axis in a direction where the additional interposed portion 112' extends, at the location where the interposed portion 112 is provided and the location where the additional interposed portion 112' is provided. Therefore, in association with this, an impulse of brake at the time of a cutting maneuver increases, and as a result, a swift and smooth cutting maneuver can be realized.

Moreover, in the case of being formed in such a manner, the additional first bar 122A', in addition to the first bar 122A and the second bar 122B, is disposed extending in a direction crossing the left-right direction. Therefore, a bending stiffness against dorsal flexion of the shoe sole 100A3 around an axis in the left-right direction also increases, and as a result of this, a function for assisting a start-off at the time of a cutting maneuver (namely, an acceleration assisting function), and a function for increasing a propulsive force to the front at the time of traveling (namely, a travel assisting function), also improve.

Therefore, in the case of being formed in such a manner, not only the effect described in the above-stated Embodiment 1 can be obtained, but also an effect can be obtained where a shoe sole with a higher performance, and a shoe including the shoe sole, can be produced.

Fourth Modified Example

Figure 13:
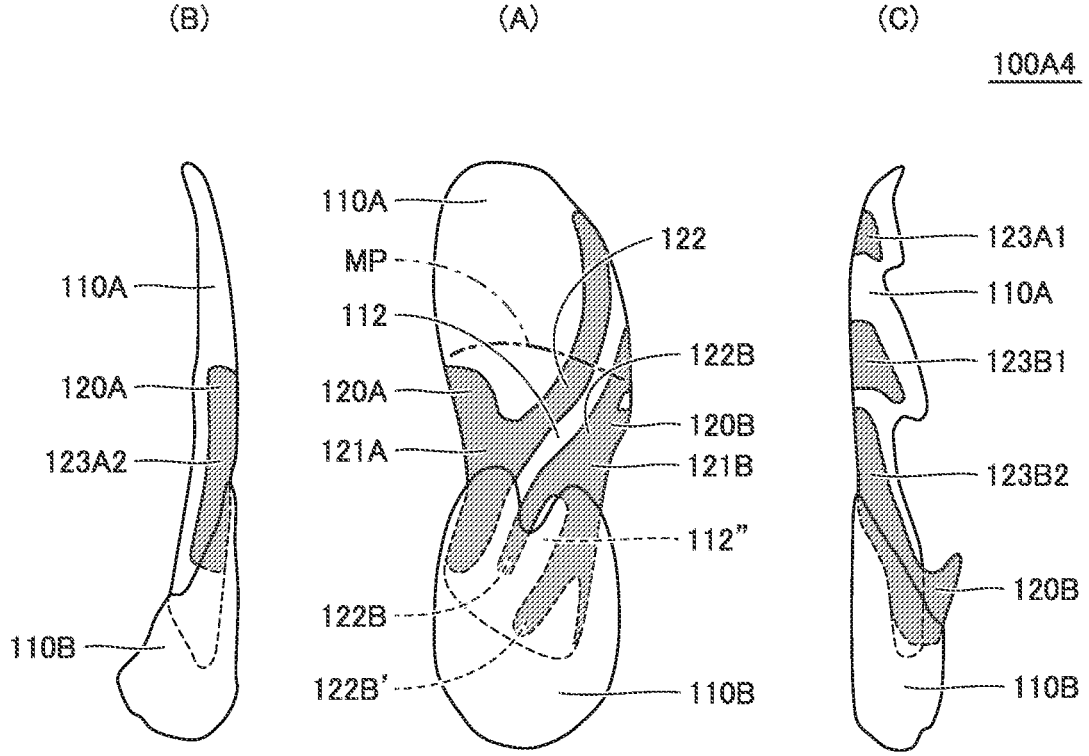
FIG. 13A is a bottom surface view.
FIG. 13B is a side surface view on a medial foot side.
FIG. 13C is a side surface view on a lateral foot side, which omit an illustration of an outsole, of a shoe sole relating to a fourth modified example.

FIG. 13(A) to FIG. 13(C) show a bottom surface view, a side surface view of a medial foot side, and a side surface view of a lateral foot side, respectively, which omit an illustration of an outsole, of a shoe sole relating to a fourth modified example. Hereinafter, a shoe sole 100A4 relating to the fourth modified example based on the above-stated Embodiment 1 will be described, with reference to FIG. 13. Note that, the shoe sole 100A4 relating to this modified example is included in the shoe 1, instead of the shoe sole 100A relating to the above-stated Embodiment 1.

As shown in FIG. 13(A) to FIG. 13(C), the shoe sole 100A4, in the case where compared with the shoe sole 100A relating to the above-stated Embodiment 1, has a configuration that is different mainly for the point of the second reinforcing member 120B has an additional second bar 122B' in addition to the second bar 122B.

Specifically, the additional second bar 122B' has an elongated approximate plate shape that covers the lower surface of the front side midsole 110A, and is disposed so as to reach a portion near the rear end of the rearfoot portion R3 on the medial foot side from a portion near the rear end of the midfoot portion R2 on the lateral foot side. In this way, the portion of the additional second bar 122B' disposed in the midfoot portion R2 extends along an oblique direction crossing both the front-rear direction and the left-right direction, such that a front end thereof is located on the lateral foot side and a rear end thereof is located on the medial foot side. Note that, the additional second bar 122B' is located on the lateral foot side from the second bar 122B.

The front end portion of the additional second bar 122B' is connected to the second base 121B. In other words, the additional second bar 122B' is provided so as to extend continuously from the second base 121B.

Here, the second bar 122B and the additional second bar 122B' of the second reinforcing member 120B are disposed with a distance therebetween in both the front-rear direction and the left-right direction. In this way, the second bar 122B and the additional second bar 122B' are located with a distance therebetween, in particular, in the midfoot portion R2.

Accordingly, an additional interposed portion 112", which is formed by a part of the midsole 110 (more strictly, a part of the front side midsole 110A) made of a material lower in rigidity than the second reinforcing member 120B, is located at a portion between the second bar 122B and the additional second bar 122B', in particular, in the midfoot portion R2. This additional interposed portion 112" is apart of the midsole 110 at a portion where the reinforcing structure portion 120 is not provided.

This additional interposed portion 112" extends along a same direction as the direction in which the second bar 122B and the additional second bar 122B' extend. In more detail, the portion of the additional interposed portion 112" disposed in the midfoot portion R2 extends along an oblique direction crossing both the front-rear direction and the left-right direction, such that a front end thereof is located on the lateral foot side and a rear end thereof is located on the medial foot side.

Accordingly, in the case of being formed in such a manner, twisting easily occurs between a portion of the forefoot portion R1 on the medial foot side and a portion of the rearfoot portion R3 on the lateral foot side, not only around an axis in a direction where the interposed portion 112 extends, but also around an axis in a direction where the additional interposed portion 112" extends, at the location where the interposed portion 112 is provided and the location where the additional interposed portion 112" is provided. Therefore, in association with this, an impulse of brake at the time of a cutting maneuver increases, and as a result, a swift and smooth cutting maneuver can be realized.

Therefore, in the case of being formed in such a manner, not only the effect described in the above-stated Embodiment 1 can be obtained, but also an effect can be obtained where a shoe sole with a higher performance, and a shoe including the shoe sole, can be produced.

Fifth Modified Example

Figure 14:
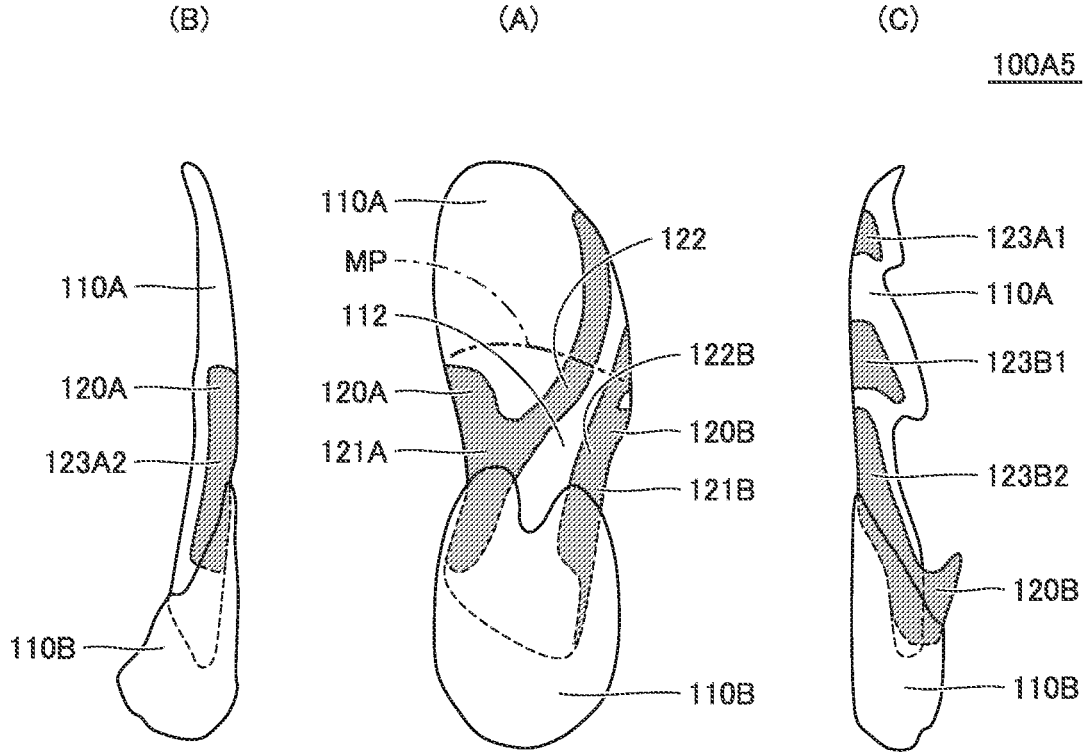
FIG. 14A is a bottom surface view.
FIG. 14B is a side surface view on a medial foot side.
FIG. 14C is a side surface view on a lateral foot side, which omit an illustration of an outsole, of a shoe sole relating to a fifth modified example.

FIG. 14(A) to FIG. 14(C) show a bottom surface view, a side surface view of a medial foot side, and a side surface view of a lateral foot side, respectively, which omit an illustration of an outsole, of a shoe sole relating to a fifth modified example. Hereinafter, a shoe sole 100A5 relating to the fifth modified example based on the above-stated Embodiment 1 will be described, with reference to FIG. 14. Note that, the shoe sole 100A5 relating to this modified example is included in the shoe 1, instead of the shoe sole 100A relating to the above-stated Embodiment 1.

As shown in FIG. 14(A) to FIG. 14(C), the shoe sole 100A5, in the case where compared with the shoe sole 100A relating to the above-stated Embodiment 1, has a configuration that is different mainly for the shape of the second reinforcing member 120B. Specifically, in the shoe sole 100A5, the second bar 122B is located so as to reach a portion near the rear end of the midfoot portion R2 on the lateral foot side from a portion near the rear end of the forefoot portion R1 on the lateral foot side. In this way, the portion of the second bar 122B disposed in the midfoot portion R2 extends along roughly the front-rear direction, such that a front end thereof is located on the lateral foot side and a rear end thereof is located on the lateral foot side.

In the case of being formed in such a manner, an effect can be obtained that conforms to the effect described in the above-stated Embodiment 1, in particular, an effect can be obtained where a shoe sole, in which a reinforcing structure portion is provided that exhibits a desired performance in accordance with a usage, and a shoe including the shoe sole, can be easily manufactured.

Sixth Modified Example

Figure 15:
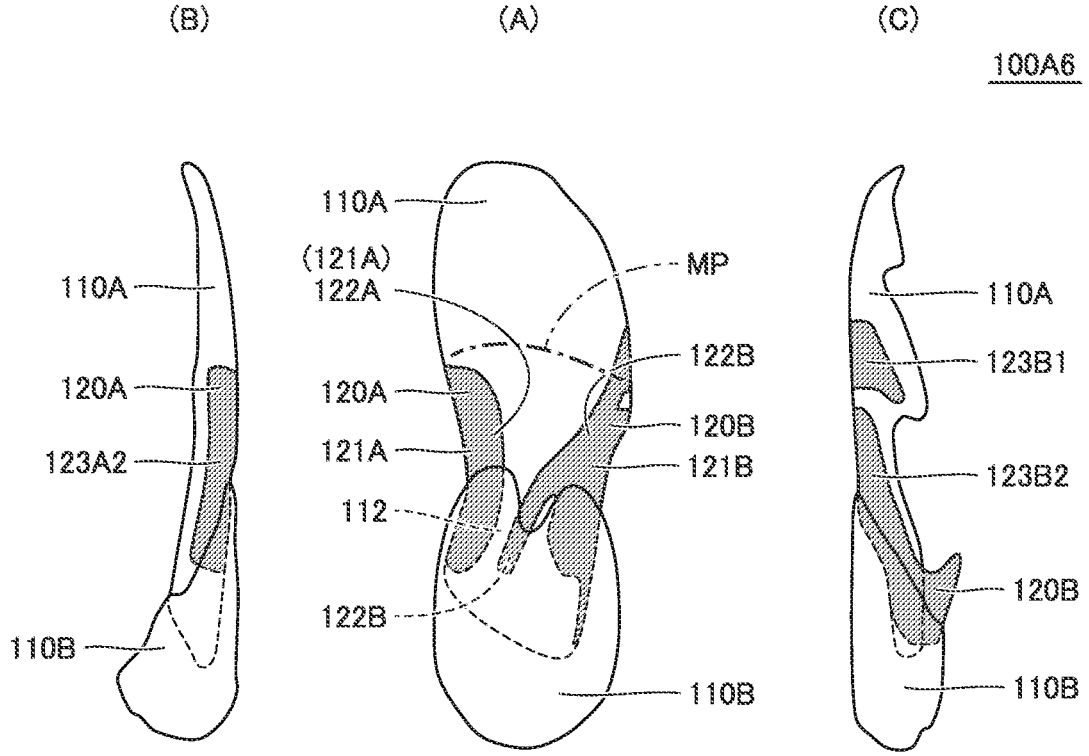
FIG. 15A is a bottom surface view.
FIG. 15B is a side surface view on a medial foot side.
FIG. 15C is a side surface view on a lateral foot side, which omit an illustration of an outsole, of a shoe sole relating to a sixth modified example.

FIG. 15(A) to FIG. 15(C) show a bottom surface view, a side surface view of a medial foot side, and a side surface view of a lateral foot side, respectively, which omit an illustration of an outsole, of a shoe sole relating to a sixth modified example. Hereinafter, a shoe sole 100A6 relating to the sixth modified example based on the above-stated Embodiment 1 will be described, with reference to FIG. 15. Note that, the shoe sole 100A6 relating to this modified example is included in the shoe 1, instead of the shoe sole 100A relating to the above-stated Embodiment 1.

As shown in FIG. 15(A) to FIG. 15(C), the shoe sole 100A6, in the case where compared with the shoe sole 100A relating to the above-stated Embodiment 1, has a configuration that is different mainly for the shape of the first reinforcing member 120A. Specifically, in the shoe sole 100A6, the first bar 122A is located so as to reach a portion near the rear end of the midfoot portion R2 on the medial foot side from a portion near the rear end of the forefoot portion R1 on the medial foot side. In this way, the portion of the first bar 122A disposed in the midfoot portion R2 extends along roughly the front-rear direction, such that a front end thereof is located on the medial foot side and a rear end thereof is located on the medial foot side.

In the case of being formed in such a manner, an effect can be obtained that conforms to the effect described in the above-stated Embodiment 1, in particular, an effect can be obtained where a shoe sole, in which a reinforcing structure portion is provided that exhibits a desired performance in accordance with a usage, and a shoe including the shoe sole, can be easily manufactured.

Seventh Modified Example

Figure 16:
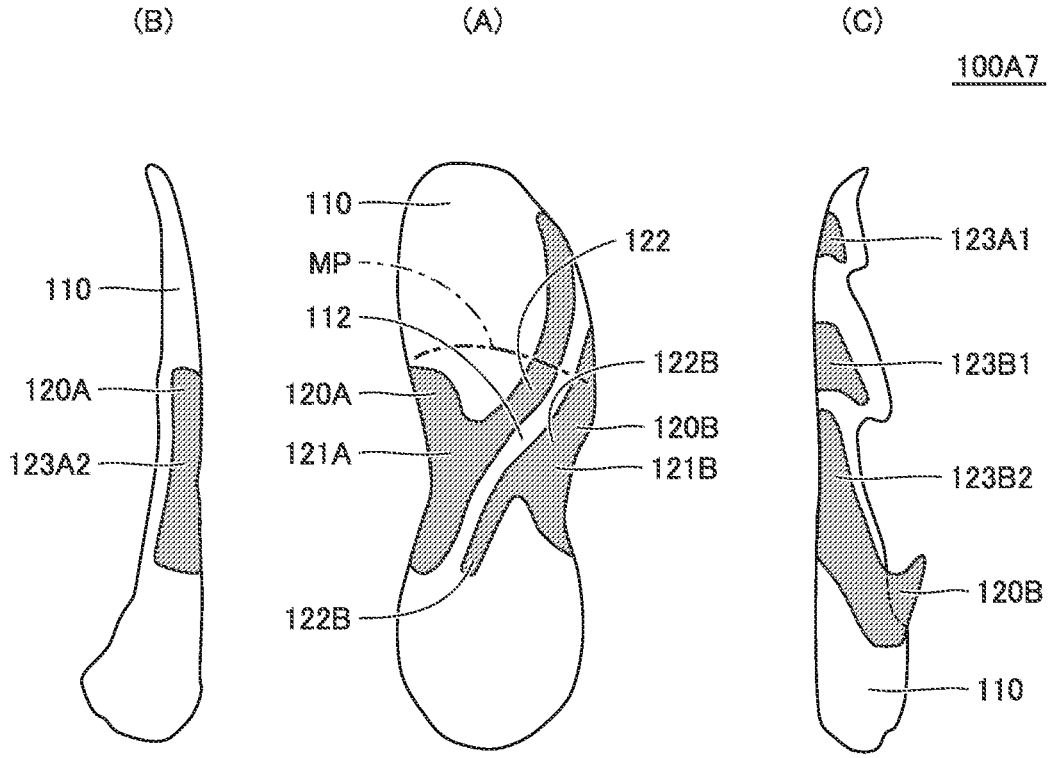
FIG. 16A is a bottom surface view.
FIG. 16B is a side surface view on a medial foot side.
FIG. 16C is a side surface view on a lateral foot side, which omit an illustration of an outsole, of a shoe sole relating to a seventh modified example.

FIG. 16(A) to FIG. 16(C) show a bottom surface view, a side surface view of a medial foot side, and a side surface view of a lateral foot side, respectively, which omit an illustration of an outsole, of a shoe sole relating to a seventh modified example. Hereinafter, a shoe sole 100A7 relating to the seventh modified example based on the above-stated Embodiment 1 will be described, with reference to FIG. 16. Note that, the shoe sole 100A7 relating to this modified example is included in the shoe 1, instead of the shoe sole 100A relating to the above-stated Embodiment 1.

As shown in FIG. 16(A) to FIG. 16(C), the shoe sole 100A7, in the case where compared with the shoe sole 100A relating to the above-stated Embodiment 1, has a configuration that is different for the midsole 110. Specifically, in the shoe sole 100A7, the midsole 110 is formed by a single member, and this is not divided into the front side midsole 110A and the rear side midsole 110B. Accordingly, the above-stated first reinforcing member 120A and second reinforcing member 120B do not have a part thereof embedded in the midsole 110, and the entire part thereof is disposed on the lower surface and the side surface of the midsole 110.

In the case of being formed in such a manner, an effect can be obtained that conforms to the effect described in the above-stated Embodiment 1, in particular, an effect can be obtained where a shoe sole, in which a reinforcing structure portion is provided that exhibits a desired performance in accordance with a usage, and a shoe including the shoe sole, can be easily manufactured.

Embodiment 2

Figure 17:
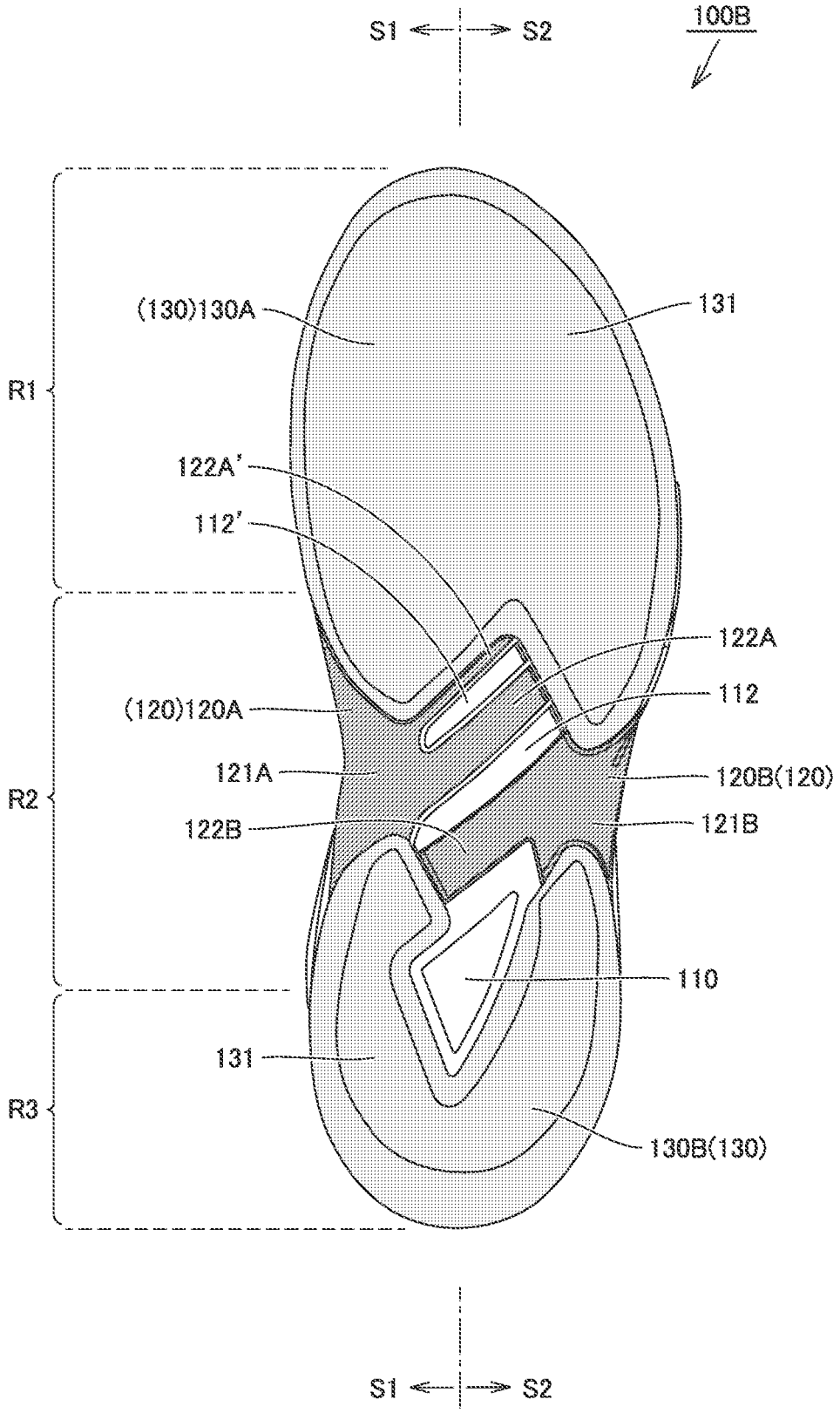
FIG. 17 is a bottom surface view of a shoe sole relating to Embodiment 2.
Figure 18:
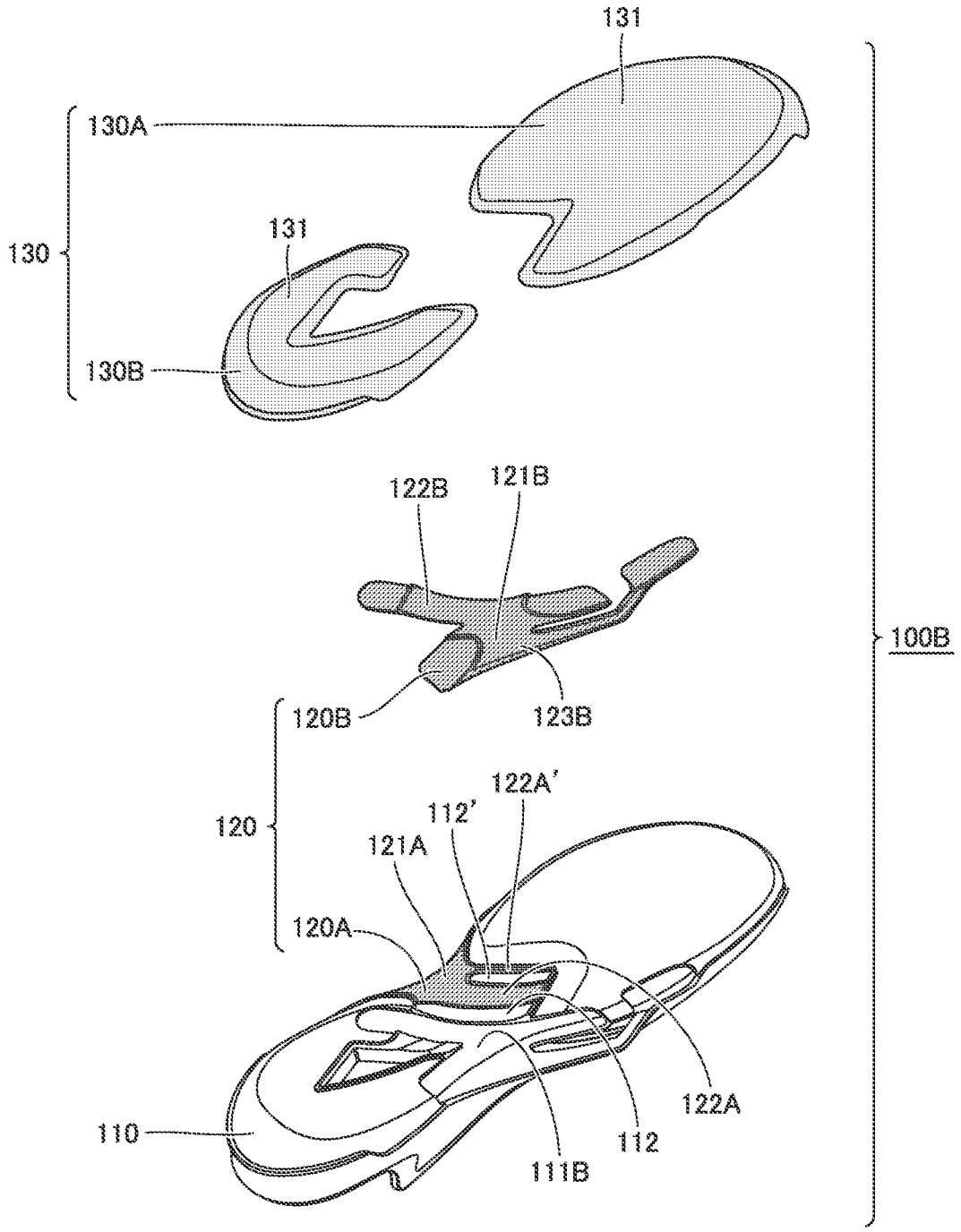
FIG. 18 is an exploded perspective view of the shoe sole shown in FIG. 17.
Figure 19:
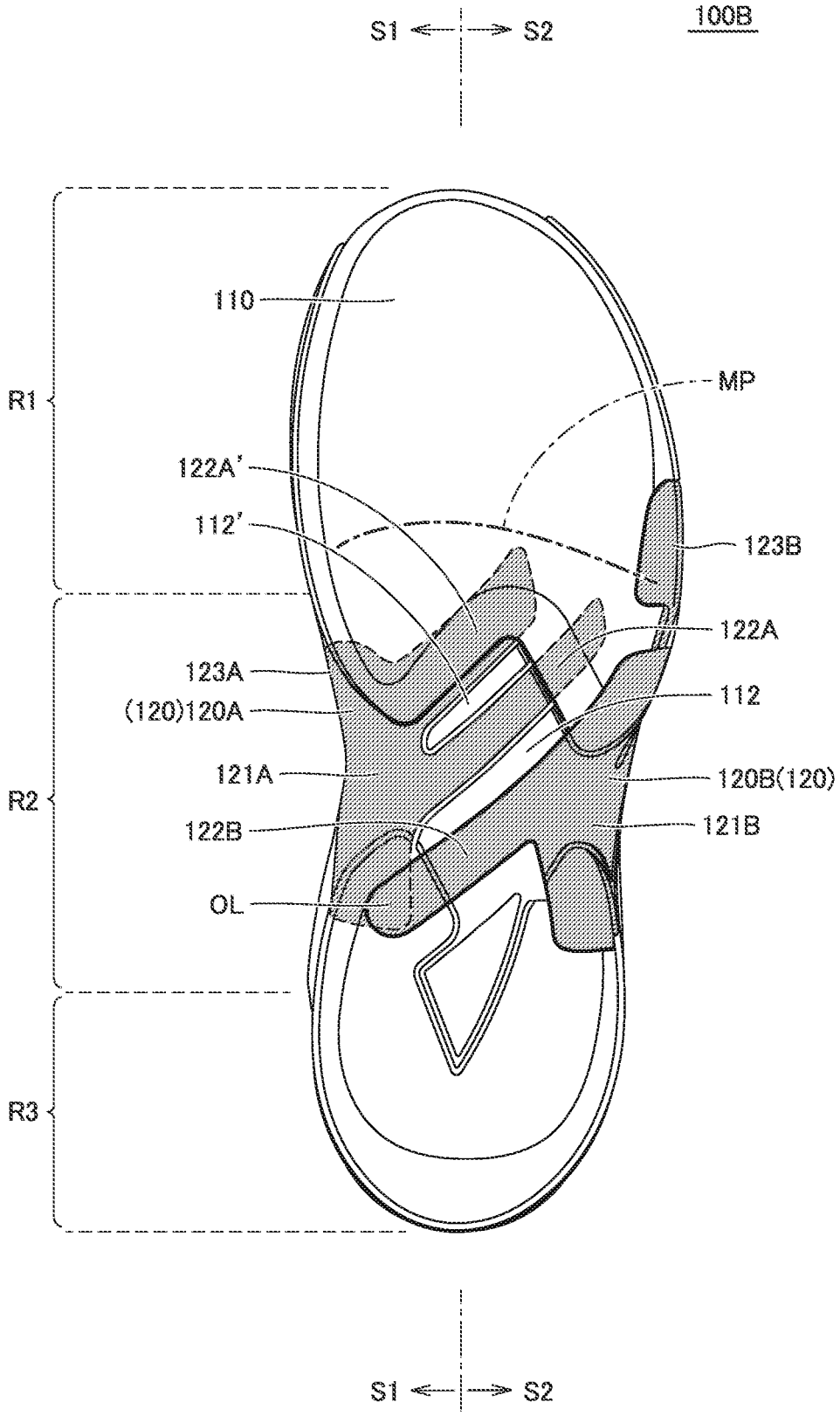
FIG. 19 is a bottom surface view showing a state where an outsole is removed from the shoe sole shown in FIG. 17.

FIG. 17 is a bottom surface view of a shoe sole relating to Embodiment 2, and FIG. 18 is an exploded perspective view of the shoe sole shown in FIG. 17. Moreover, FIG. 19 is a bottom surface view showing a state where an outsole is removed from the shoe sole shown in FIG. 17. Hereinafter, a shoe sole 100B relating to the present embodiment will be described, with reference to FIG. 17 to FIG. 19. Note that, the shoe sole 100B relating to the present embodiment is included in the shoe 1, instead of the shoe sole 100A relating to Embodiment 1.

As shown in FIG. 17 and FIG. 18, while the shoe sole 100B, similar to the shoe sole 100A relating to the above-stated Embodiment 1, has the midsole 110, the reinforcing structure portion 120, and the outsole 130, the configuration of each of these is different to that of the shoe sole 100A relating to the above-stated Embodiment 1.

In the shoe sole 100B, the midsole 110 as a sole body is made of a single member, and this midsole 110 made of a single member is located continuously from the forefoot portion R1 to the rearfoot portion R3. The outsole 130 includes a front side outsole 130A and a rear side outsole 130B, and the outsole 130 formed from the front side outsole 130A and the rear side outsole 130B, apart from a part of the midfoot portion R2, is located continuously from roughly the forefoot portion R1 to the rearfoot portion R3.

The reinforcing structure portion 120 includes a first reinforcing member 120A, and a second reinforcing member 120B made of a different member from the first reinforcing member 120A. The first reinforcing member 120A is located on the medial foot side from the second reinforcing member 120B, and the second reinforcing member 120B is located on the lateral foot side from the first reinforcing member 120A.

The first reinforcing member 120A and the second reinforcing member 120B are both formed of a material higher in rigidity than the material forming the midsole 110. Namely, the first reinforcing member 120A and the second reinforcing member 120B have a higher Young's modulus and are harder than the midsole 110. Note that, the first reinforcing member 120A is embedded in the midsole 110 beforehand by insert molding, two-color molding or the like.

As shown in FIG. 17 to FIG. 19, the first reinforcing member 120A has a first base 121A, a first bar 122A, an additional first bar 122A', and a first rising wall 123A. On the other hand, the second reinforcing member 120B has a second base 121B, a second bar 122B, and a second rising wall 123B.

The first bar 122A is disposed so as to reach a portion near the rear end of the midfoot portion R2 on the medial foot side from a portion near the front end of the midfoot portion R2 on the lateral foot side. In this way, the first bar 122A extends along an oblique direction crossing both the front-rear direction and the left-right direction, such that a front end thereof is located on the lateral foot side and a rear end thereof is located on the medial foot side.

The additional first bar 122A' is disposed so as to reach a portion near the front end of the midfoot portion R2 on the medial foot side from a portion near the rear end of the forefoot portion R1 on the lateral foot side. In this way, the portion of the additional first bar 122A' disposed in the midfoot portion R2 extends along an oblique direction crossing both the front-rear direction and the left-right direction, such that a front end thereof is located on the lateral foot side and a rear end thereof is located on the medial foot side. Note that, the additional first bar 122A' is located on the medial foot side from the first bar 122A.

The rear end portion of the first bar 122A and the rear end portion of the additional first bar 122A' are both connected to the first base 121A. The first base 121A extends in roughly the front-rear direction along an edge portion of the midfoot portion R2 on the medial foot side. Moreover, the first rising wall 123A is provided at an end portion of the first base 121A on the medial foot side so as to cover a part of the side surface of the midsole 110 on the medial foot side.

The second bar 122B is disposed so as to reach a portion near the rear end of the midfoot portion R2 on the medial foot side from a portion near the front end of the midfoot portion R2 on the lateral foot side. In this way, the second bar 122B extends along an oblique direction crossing both the front-rear direction and the left-right direction, such that a front end thereof is located on the lateral foot side and a rear end thereof is located on the medial foot side.

The front end portion of the second bar 122B is connected to the second base 121B. The second base 121B extends in roughly the front-rear direction along an edge portion of the midfoot portion R2 on the lateral foot side. Moreover, the second rising wall 123B is provided at an end portion of the second base 121B on the lateral foot side so as to cover a part of the side surface of the midsole 110 on the lateral foot side, and the second rising wall 123B reaches a portion near the rear end of the forefoot portion R1 on the lateral foot side (namely, the side surface and the lower surface of this portion).

Here, the rear end portion of the second bar 122B overlaps the rear end portion of the first base 121A. In this way, an overlapping region OL, in which a part of the first reinforcing member 120A and a part of the second reinforcing member 120B are overlapping in the up-down direction, is formed in a portion near the rear end of the midfoot portion R2 on the medial foot side.

The first bar 122A of the first reinforcing member 120A and the second bar 122B of the second reinforcing member 120B are disposed with a distance therebetween, in both the front-rear direction and the left-right direction. Moreover, the first bar 122A and the additional first bar 122A' of the first reinforcing member 120A are also disposed with a distance therebetween, in both the front-rear direction and the left-right direction. In this way, the first bar 122A and the second bar 122B, and the first bar 122A and the additional first bar 122A', are each located with a distance therebetween.

Accordingly, an interposed portion 112 and an additional interposed portion 112', which are each formed by a part of the midsole 110 (more strictly, a part of the front side midsole 110A) made of a material lower in rigidity than each of the first reinforcing member 120A and the second reinforcing member 120B, are respectively located at a portion between the first bar 122A and the second bar 122B and a portion between the first bar 122A and the additional first bar 122A', in particular, in the midfoot portion R2. This interposed portion 112 and this additional interposed portion 112' are each a part of the midsole 110 at a portion where the reinforcing structure portion 120 is not provided.

Accordingly, in the case of being formed in such a manner, twisting easily occurs between a portion of the forefoot portion R1 on the medial foot side and a portion of the rearfoot portion R3 on the lateral foot side, not only around an axis in a direction where the interposed portion 112 extends, but also around an axis in a direction where the additional interposed portion 112' extends, at the location where the interposed portion 112 is provided and the location where the additional interposed portion 112' is provided. Therefore, in association with this, an impulse of brake at the time of a cutting maneuver increases, and as a result, a swift and smooth cutting maneuver can be realized.

Therefore, in the case of being formed in such a manner, an effect can be obtained that conforms to the effect described in the above-stated Embodiment 1.

SUMMARY OF THE DISCLOSED CONTENT IN THE EMBODIMENTS

When summarizing the characteristic configurations disclosed in the above-stated Embodiments 1 and 2, and modified examples, these characteristic configurations are as follows.

A shoe sole according to a certain aspect of the present disclosure is a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a sole body and a reinforcing structure portion. The sole body is located continuously from the forefoot portion to the rearfoot portion, and the reinforcing structure portion is assembled on the sole body. The reinforcing structure portion has a first reinforcing member formed of a material higher in rigidity than a material forming the sole body, and a second reinforcing member formed of a material higher in rigidity than the material forming the sole body, the second reinforcing member being made of a different member from the first reinforcing member. The first reinforcing member includes a first bar with at least a portion thereof disposed in the midfoot portion, and the second reinforcing member includes a second bar with at least a portion thereof disposed in the midfoot portion. The first bar is located on a medial foot side from the second bar in a left-right direction that is a direction coinciding with a foot width direction of the foot of the wearer. The portion of the first bar disposed in the midfoot portion extends along an oblique direction crossing both the front-rear direction and the left-right direction such that a front end thereof is located on a lateral foot side in the left-right direction and a rear end thereof is located on the medial foot side in the left-right direction. The portion of the second bar disposed in the midfoot portion extends crossing the left-right direction such that a front end thereof is located on the lateral foot side in the left-right direction. The portion of the first bar disposed in the midfoot portion and the portion of the second bar disposed in the midfoot portion are located at least in part with a distance therebetween.

In the shoe sole according to the certain aspect of the present disclosure, the first bar may extend crossing a portion corresponding to a metatarsophalangeal joint of the foot of the wearer such that a front end thereof is located in the forefoot portion.

In the shoe sole according to the certain aspect of the present disclosure, the first reinforcing member may include a lateral foot side first rising wall erected from the first bar along a side surface of the sole body on the lateral foot side.

In the shoe sole according to the certain aspect of the present disclosure, the first reinforcing member may include a first base disposed along an edge portion of the midfoot portion on the medial foot side in the left-right direction, and in this case, the first bar may be connected to the first base.

In the shoe sole according to the certain aspect of the present disclosure, the first reinforcing member may include a medial foot side first rising wall erected from the first base along a side surface of the sole body on the medial foot side.

In the shoe sole according to the certain aspect of the present disclosure, the first reinforcing member may include an additional first bar extending along an oblique direction crossing both the front-rear direction and the left-right direction such that a front end thereof is located on the lateral foot side in the left-right direction and a rear end thereof is located on the medial foot side in the left-right direction, and in this case, the additional first bar may be located on the medial foot side from the first bar in the left-right direction, and may be connected to the first base such as to be located with a distance from the first bar.

In the shoe sole according to the certain aspect of the present disclosure, the second bar may extend crossing a portion corresponding to a metatarsophalangeal joint of the foot of the wearer such that a front end thereof is located in the forefoot portion.

In the shoe sole according to the certain aspect of the present disclosure, the portion of the second bar disposed in the midfoot portion may extend along an oblique direction crossing the front-rear direction such that a rear end thereof is located on the medial foot side in the left-right direction.

In the shoe sole according to the certain aspect of the present disclosure, the portion of the second bar disposed in the midfoot portion may extend along the front-rear direction such that a rear end thereof is located on the lateral foot side in the left-right direction.

In the shoe sole according to the certain aspect of the present disclosure, the second reinforcing member may include a front side second rising wall erected from the second bar along a side surface of the sole body on the lateral foot side.

In the shoe sole according to the certain aspect of the present disclosure, the second reinforcing member may include a second base disposed along an edge portion of the midfoot portion on the lateral foot side in the left-right direction, and in this case, the second bar may be connected to the second base.

In the shoe sole according to the certain aspect of the present disclosure, the second reinforcing member may include a rear side second rising wall erected from the second base along a side surface of the sole body on the lateral foot side.

In the shoe sole according to the certain aspect of the present disclosure, the second reinforcing member may include an additional second bar extending along an oblique direction crossing both the front-rear direction and the left-right direction such that a front end thereof is located on the lateral foot side in the left-right direction and a rear end thereof is located on the medial foot side in the left-right direction, and in this case, the additional second bar may be located on the lateral foot side from the second bar in the left-right direction, and may be connected to the second base such as to be located with a distance from the second bar.

A shoe sole according to another aspect of the present disclosure is a shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole including a sole body and a reinforcing structure portion. The sole body is located continuously from the forefoot portion to the rearfoot portion, and the reinforcing structure portion is assembled on the sole body. The reinforcing structure portion has a first reinforcing member formed of a material higher in rigidity than a material forming the sole body, and a second reinforcing member formed of a material higher in rigidity than the material forming the sole body, the second reinforcing member being made of a different member from the first reinforcing member. The first reinforcing member includes a first bar with at least a portion thereof disposed in the midfoot portion, and the second reinforcing member includes a second bar with at least a portion thereof disposed in the midfoot portion. The first bar is located on a medial foot side from the second bar in a left-right direction that is a direction coinciding with a foot width direction of the foot of the wearer. The portion of the first bar disposed in the midfoot portion extends crossing the left-right direction such that a rear end thereof is located on the medial foot side in the left-right direction. The portion of the second bar disposed in the midfoot portion extends along an oblique direction crossing both the front-rear direction and the left-right direction such that a front end thereof is located on a lateral foot side in the left-right direction and a rear end thereof is located on the medial foot side in the left-right direction. The portion of the first bar disposed in the midfoot portion and the portion of the second bar disposed in the midfoot portion are located at least in part with a distance therebetween.

In the shoe sole according to the another aspect of the present disclosure, the second bar may extend crossing a portion corresponding to a metatarsophalangeal joint of the foot of the wearer such that a front end thereof is located in the forefoot portion.

In the shoe sole according to the another aspect of the present disclosure, the second reinforcing member may include a front side second rising wall erected from the second bar along a side surface of the sole body on the lateral foot side.

In the shoe sole according to the another aspect of the present disclosure, the second reinforcing member may include a second base disposed along an edge portion of the midfoot portion on the lateral foot side in the left-right direction, and in this case, the second bar may be connected to the second base.

In the shoe sole according to the another aspect of the present disclosure, the second reinforcing member may include a rear side second rising wall erected from the second base along a side surface of the sole body on the lateral foot side.

In the shoe sole according to the another aspect of the present disclosure, the second reinforcing member may include an additional second bar extending along an oblique direction crossing both the front-rear direction and the left-right direction such that a front end thereof is located on the lateral foot side in the left-right direction and a rear end thereof is located on the medial foot side in the left-right direction, and in this case, the additional second bar may be located on the lateral foot side from the second bar in the left-right direction, and may be connected to the second base such as to be located with a distance from the second bar.

In the shoe sole according to the another aspect of the present disclosure, the first bar may extend crossing a portion corresponding to a metatarsophalangeal joint of the foot of the wearer such that a front end thereof is located in the forefoot portion.

In the shoe sole according to the another aspect of the present disclosure, the portion of the first bar disposed in the midfoot portion may extend crossing the front-rear direction such that a front end thereof is located on the medial foot side in the left-right direction.

In the shoe sole according to the another aspect of the present disclosure, the first reinforcing member may include a lateral foot side first rising wall erected from the first bar along a side surface of the sole body on the lateral foot side.

In the shoe sole according to the another aspect of the present disclosure, the portion of the first bar disposed in the midfoot portion may extend along the front-rear direction such that a front end thereof is located on the medial foot side in the left-right direction.

In the shoe sole according to the another aspect of the present disclosure, the first reinforcing member may include a first base disposed along an edge portion of the midfoot portion on the medial foot side in the left-right direction, and in this case, the first bar may be connected to the first base.

In the shoe sole according to the another aspect of the present disclosure, the first reinforcing member may include a medial foot side first rising wall erected from the first base along a side surface of the sole body on the medial foot side.

In the shoe sole according to the another aspect of the present disclosure, the first reinforcing member may include an additional first bar extending along an oblique direction crossing both the front-rear direction and the left-right direction such that a front end thereof is located on the lateral foot side in the left-right direction and a rear end thereof is located on the medial foot side in the left-right direction, and in this case, the additional first bar may be located on the medial foot side from the first bar in the left-right direction, and may be connected to the first base such as to be located with a distance from the first bar.

In the shoe sole according to the certain aspect or the another aspect of the present disclosure, at least one part of the first reinforcing member and at least one part of the second reinforcing member may be located so as to cover an outer surface of the sole body.

In the shoe sole according to the certain aspect or the another aspect of the present disclosure, at least one part of the first reinforcing member and at least one part of the second reinforcing member may be embedded in the sole body.

In the shoe sole according to the another aspect of the present disclosure, a part of the first reinforcing member may overlap with a part of the second reinforcing member in a case where seen along an up-down direction orthogonal to both the front-rear direction and the left-right direction.

A shoe according to a certain aspect of the present disclosure includes either the shoe sole according to the certain aspect of the present disclosure or the shoe sole according to the another aspect of the present disclosure, and an upper located above the shoe sole.

Other Embodiments

The specific shape, configuration, number, and location of each part shown in the above-stated Embodiment 1, Embodiment 2, and modified examples can be appropriately modified. For example, the first bar and the second bar may not be formed in a plate shape, and may be formed in a rod shape. A plurality of the additional first bars and additional second bars may be provided.

Moreover, in the above-stated Embodiment 1, Embodiment 2, and modified examples, while an explanation has been performed by exemplifying a case where the first bar and the second bar are not only provided in the midfoot portion, but also have a part thereof reaching the forefoot portion, the first bar and the second bar may be provided so as to reach the rearfoot portion, or may be provided in only the midfoot portion. Here, by having the first bar and the second bar provided in at least a part of the midfoot portion, and having the first bar and the second bar located in at least one part of the midfoot portion with a distance therebetween, an assisting function for swiftly and smoothly performing the above-stated cutting maneuver is suitably exhibited.

In addition, in the above-stated Embodiment 1, Embodiment 2, and modified examples, while an explanation has been performed by exemplifying a shoe formed so that the upper body is brought into close contact with the foot by using a shoelace, it may be a shoe formed so that the upper body is brought into close contact with the foot by a hook fastener, or may be a shoe formed so that the upper body is brought into close contact with the foot by forming a sock shaped upper body and thereby only inserting the foot into the upper body. Namely, the shape of the upper is capable of being appropriately modified in accordance with the usage of the shoe.

In addition, the characteristic configurations disclosed in the above-stated Embodiment 1, Embodiment 2, and modified examples are capable of being combined together, in a scope that does not deviate from the meaning of the present invention.

In this way, the embodiments and modified examples shown in the present disclosure are exemplifications for all of the points, and are not limited exemplifications. The technical scope of the present invention is defined by the claims, and includes all modifications within the meaning and scope equivalent to the description of the claims.

REFERENCE SIGNS LIST

1 shoe, 100A, 100A1-100A7, 100B shoe sole, 110 midsole, 110A front side midsole, 110B rear side midsole, 111A first housing portion, 111B second housing portion, 112 interposed portion, 112',112" additional interposed portion, 120 reinforcing structure portion, 120A first reinforcing member, 120B second reinforcing member, 121A first base, 121B second base, 122A first bar, 122A' additional first bar, 122B second bar, 122B' additional second bar, 123A first rising wall, 123A1 lateral foot side first rising wall, 123A2 medial foot side first rising wall, 123B second rising wall, 123B1 front side second rising wall, 123B2 rear side second rising wall, 130 outsole, 130A front side outsole, 130B rear side outsole, 130B1 rear medial foot side outsole, 130B2 rear lateral foot side outsole, 131 ground contact surface, 200 upper, 210 upper body, 220 shoe tongue, 230 shoelace, OL overlapping region, R1 forefoot portion, R2 midfoot portion, R3 rearfoot portion

The invention claimed is:

1. A shoe sole in which a forefoot portion for supporting a toe portion and a ball portion of a foot of a wearer, a midfoot portion for supporting an arch portion of the foot of the wearer, and a rearfoot portion for supporting a heel portion of the foot of the wearer are provided to be connected along a front-rear direction that is a direction coinciding with a foot length direction of the foot of the wearer, the shoe sole comprising:

a sole body located continuously from the forefoot portion to the rearfoot portion; and a reinforcing structure portion assembled on the sole body, wherein the reinforcing structure portion has a first reinforcing member formed of a material higher in rigidity than a material forming the sole body, and a second reinforcing member formed of a material higher in rigidity than the material forming the sole body, the second reinforcing member being made of a different member from the first reinforcing member, the first reinforcing member includes a first bar with at least a portion thereof disposed in the midfoot portion, the second reinforcing member includes a second bar with at least a portion thereof disposed in the midfoot portion, the first bar is located on a medial foot side from the second bar in a left-right direction that is a direction coinciding with a foot width direction of the foot of the wearer, the portion of the first bar disposed in the midfoot portion extends along an oblique direction crossing both the front-rear direction and the left-right direction such that a front end thereof is located on a lateral foot side in the left-right direction and a rear end thereof is located on the medial foot side in the left-right direction, the portion of the second bar disposed in the midfoot portion extends crossing the left-right direction such that a front end thereof is located on the lateral foot side in the left-right direction, the portion of the first bar disposed in the midfoot portion and the portion of the second bar disposed in the midfoot portion are located at least in part with a distance therebetween, and the first and second reinforcing members are separated by an interposed portion that extends obliquely in one direction from a lateral foot side of the midfoot portion to a medial foot side of the midfoot portion in a direction from the forefoot portion towards the toe portion, such that the first and second reinforcing members are not in direct contact with each other on the shoe sole.

2. The shoe sole according to claim 1, wherein the first bar extends crossing a portion corresponding to a metatarsophalangeal joint of the foot of the wearer such that a front end thereof is located in the forefoot portion.

3. The shoe sole according to claim 2, wherein the first reinforcing member includes a lateral foot side first rising wall erected from the first bar along a side surface of the sole body on the lateral foot side.

4. The shoe sole according to claim 1, wherein the first reinforcing member includes a first base disposed along an edge portion of the midfoot portion on the medial foot side in the left-right direction, and the first bar is connected to the first base.

5. The shoe sole according to claim 4, wherein the first reinforcing member includes a medial foot side first rising wall erected from the first base along a side surface of the sole body on the medial foot side.

6. The shoe sole according to claim 4, wherein the first reinforcing member includes an additional first bar extending along an oblique direction crossing both the front-rear direction and the left-right direction such that a front end thereof is located on the lateral foot side in the left-right direction and a rear end thereof is located on the medial foot side in the left-right direction, and the additional first bar is located on the medial foot side from the first bar in the left-right direction, and is connected to the first base such as to be located with a distance from the first bar.

7. The shoe sole according to claim 1, wherein the second bar extends crossing a portion corresponding to a metatarsophalangeal joint of the foot of the wearer such that a front end thereof is located in the forefoot portion.

8. The shoe sole according to claim 1, wherein the portion of the second bar disposed in the midfoot portion extends along an oblique direction crossing the front-rear direction such that a rear end thereof is located on the medial foot side in the left-right direction.

9. The shoe sole according to claim 1, wherein the portion of the second bar disposed in the midfoot portion extends along the front-rear direction such that a rear end thereof is located on the lateral foot side in the left-right direction.

10. The shoe sole according to claim 1, wherein the second reinforcing member includes a front side second rising wall erected from the second bar along a side surface of the sole body on the lateral foot side.

11. The shoe sole according to claim 1, wherein the second reinforcing member includes a second base disposed along an edge portion of the midfoot portion on the lateral foot side in the left-right direction, and the second bar is connected to the second base.

12. The shoe sole according to claim 11, wherein the second reinforcing member includes a rear side second rising wall erected from the second base along a side surface of the sole body on the lateral foot side.

13. The shoe sole according to claim 11, wherein the second reinforcing member includes an additional second bar extending along an oblique direction crossing both the front-rear direction and the left-right direction such that a front end thereof is located on the lateral foot side in the left-right direction and a rear end thereof is located on the medial foot side in the left-right direction, and the additional second bar is located on the lateral foot side from the second bar in the left-right direction, and is connected to the second base such as to be located with a distance from the second bar.

14. The shoe sole according to claim 1, wherein at least one part of the first reinforcing member and at least one part of the second reinforcing member are located so as to cover an outer surface of the sole body.

15. The shoe sole according to claim 1, wherein at least one part of the first reinforcing member and at least one part of the second reinforcing member are embedded in the sole body.

16. The shoe sole according to claim 1, wherein a part of the first reinforcing member overlaps with a part of the second reinforcing member in a case where seen along an up-down direction orthogonal to both the front-rear direction and the left-right direction.

17. A shoe comprising:

the shoe sole according to claim 1; and an upper located above the shoe sole.

* * * * *